US011281147B2

(12) United States Patent
Tanaka et al.

(10) Patent No.: US 11,281,147 B2
(45) Date of Patent: Mar. 22, 2022

(54) DRIVING DEVICE AND IMAGE FORMING APPARATUS

(71) Applicant: CANON KABUSHIKI KAISHA, Tokyo (JP)

(72) Inventors: Masaki Tanaka, Kawasaki (JP); Noritomo Yamaguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/987,737

(22) Filed: Aug. 7, 2020

(65) Prior Publication Data

US 2021/0041824 A1 Feb. 11, 2021

(30) Foreign Application Priority Data

Aug. 7, 2019 (JP) ..... JP2019-145040

(51) Int. Cl.
*G03G 15/00* (2006.01)

(52) U.S. Cl.
CPC ..... *G03G 15/757* (2013.01)

(58) Field of Classification Search
CPC ..... G03G 15/757; G03G 21/1857
See application file for complete search history.

(56) References Cited

U.S. PATENT DOCUMENTS 5,436,699 A * 7/1995 Komaki ..... G03G 15/751 399/159
5,534,894 A * 7/1996 Hirano ..... B41J 2/16523 346/134
6,401,893 B1 * 6/2002 Kinoshita ..... F16D 41/069 192/113.32
9,121,475 B2 9/2015 Kuroda et al. ..... G03G 21/1676
9,599,951 B2 3/2017 Yamaguchi et al. ..... G03G 21/1695
10,571,858 B2 * 2/2020 Kawamura ..... G03G 21/185
2004/0129380 A1 * 7/2004 Murphy ..... B23P 21/006 156/256
2007/0177899 A1 * 8/2007 Kawamura ..... G03G 15/0896 399/223
2017/0248171 A1 * 8/2017 Kawamura ..... G03G 21/1647
2018/0239299 A1 * 8/2018 Zhou ..... G03G 15/5008
2018/0348695 A1 * 12/2018 Ueno ..... F16D 1/108

FOREIGN PATENT DOCUMENTS

JP 58021051 A * 2/1983 ..... G03G 15/757
JP 2014119102 A * 6/2014
JP 2017-151379 A 8/2017

* cited by examiner

*Primary Examiner* — Sevan A Aydin
(74) *Attorney, Agent, or Firm* — Venable LLP

(57) ABSTRACT

A driving device for photosensitive members and developing rollers includes a clutch for selectively transmitting a rotational force from a driving source to the rollers. The clutch includes a rotatable driving member having a first engaging portion together with the first portion, a follower having a second engaging portion engageable with the first portion, and a rotatable member changeable, by rotation in a direction opposite from a rotational direction of the driving member, from a first state in which the driving force from the driving source is not transmitted without engagement between the first portion and the second engaging portion to a second state in which the rotor rotates by engagement therebetween. The rotor urges the follower in the opposite direction when the first engageable member and the second engageable member are not engaged with each other, by the opposite rotation.

18 Claims, 13 Drawing Sheets

DRIVING DEVICE AND IMAGE FORMING APPARATUS

FIELD OF THE INVENTION AND RELATED ART

The present invention relates to a driving device for rotationally driving two or more photosensitive members, and two or more development rollers. It relates also an image forming apparatus equipped with the abovementioned driving device.

Here, an image forming apparatus means what forms an image on recording medium with the use of an electrophotographic image forming method. As examples of an electrophotographic image forming apparatus, an electrophotographic copying machine, an electrophotographic printer (laser printer, LED printer, or the like, for example), a facsimileing apparatus, a word processor, and the like can be included.

In the past, as one of the methods for preventing the developer and development rollers in an image forming apparatus from deteriorating, it has been known to separately control a photosensitive member and a development roller to minimize the development roller in the number of rotations.

Further, there has been known to structure an image forming apparatus so that it employs only a single motor to drive its photosensitive member and development roller to reduce the apparatus in size and cost. This type of image forming apparatus has been known to be structured so that its driving unit is provided with a clutch to prevent any component of the apparatus from being unnecessarily driven.

In recent years, a mechanical clutching mechanism, which is low in cost, affords more latitude in terms of shape, and resistant to such malfunctioning as slipping, has come to be widely used as a means for interrupting the transmission of driving force.

A mechanical clutching mechanism, however, has been known to be subjected to a substantial amount of shock when it is engaged or disengaged, in spite of the fact that it enjoys such advantages as those described above.

Thus, there has been proposed a mechanical clutching mechanism structured so that its disengaging member is movable in the direction parallel to its rotational axis to separate the driving member from a member to be driven, in order to disengage the driving member and member to be driven from each other, and also, so that as soon as the disengaging member stops, the driving member and the member to be driven are made to engage with each other by the pressure generated by a coil spring (Japanese Laid-open Patent Application No. 2017-151379).

In the case of this mechanical clutching mechanism, the engaging member on the driving side is kept pressed in the positive direction in terms of its normal rotation to prevent the problem that the substantial amount of shock might occur when the driving member, and member to be driven, are engaged with each other.

In the case of the example of a conventional clutching mechanism described above, the engaging member on the driving side remains pressed in the positive direction in terms of its normal rotation. Therefore, as the driving member, and the member to be driven, are disengaged from each other, the engaging member on the driving side is rotated in the positive direction, by the pressure applied thereto. Therefore, there has been the problem that the engaging member on the driving side collides with the engaging member of the member to driven, and therefore, suddenly generates a substantial amount of collisional noises.

SUMMARY OF THE INVENTION

According to an aspect of the present invention, a driving device for rotating for rotating a plurality of photosensitive members and a plurality of developing rollers, said driving device comprising a clutch configured to selectively transmit a rotational force outputted from a driving source, to the developing rollers; said clutch including, a driving member provided with a first engaging portion and rotatable about an axis thereof by receiving the rotational force outputted from said driving source together with said first engaging portion, a follower member provided with a second engaging portion engageable with said first engaging portion, said follower member being rotatable about the axis together with said second engaging portion, a rotatable member capable of changing, by rotation in a direction opposite from a rotational direction of said driving member, a state from a first state in which the driving force from said driving source is not transmitted without engagement between said first engaging portion and said second engaging portion to a second state in which said rotatable member is rotated by engagement between said first engaging portion and said second engaging portion, wherein said rotatable member urges said follower member in the opposite rotational direction when said first engageable member and said second engageable member are not engaged with each other, by rotation in the opposite rotational direction.

Further features of the present invention will become apparent from the following description of exemplary embodiments with reference to the attached drawings.

Figure 5:
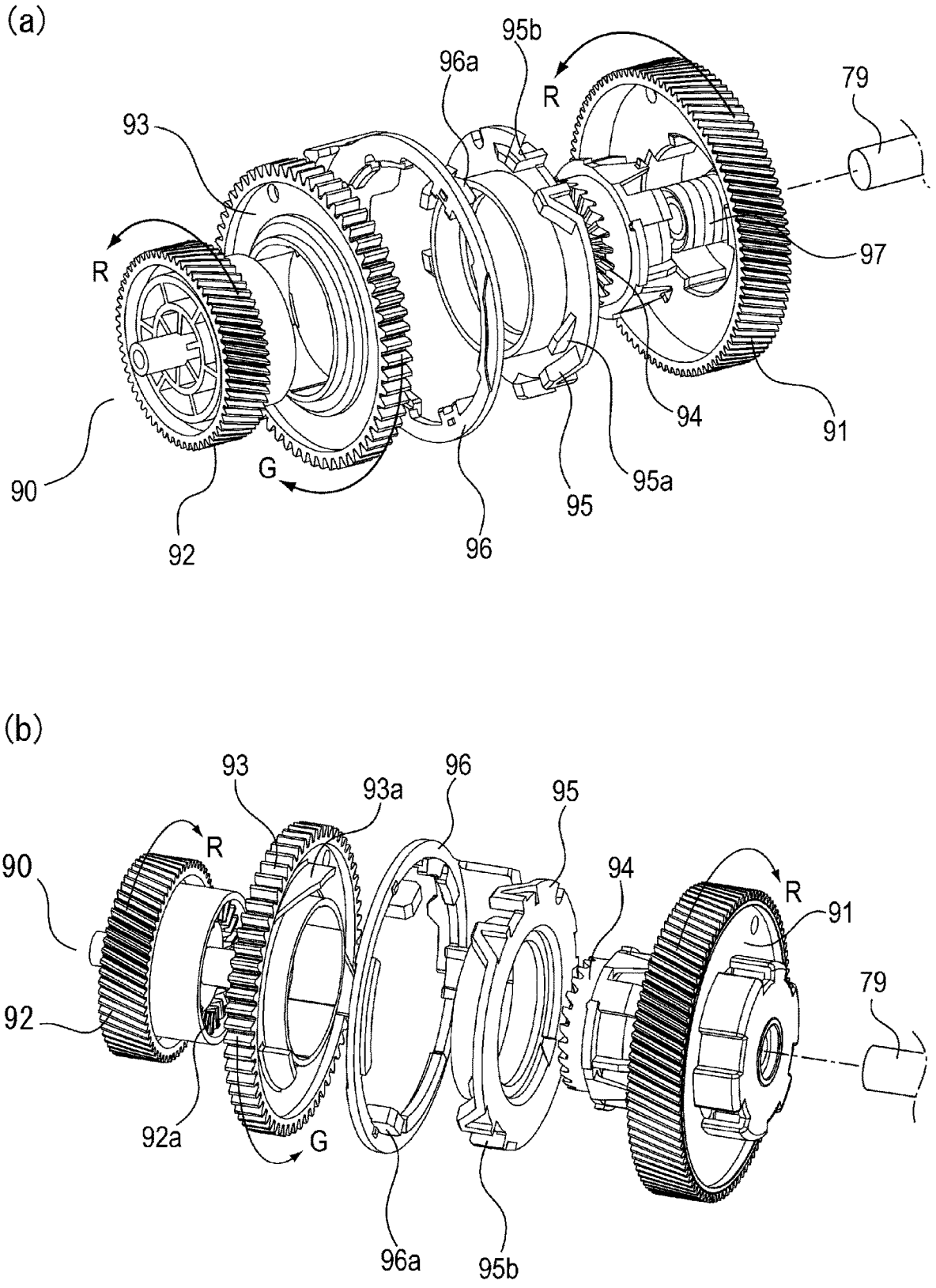

Part (a) of FIG. 5 and part (b) of FIG. 5 are perspective views of the mechanical clutching mechanism in the first embodiment of the present invention.

Figure 6:
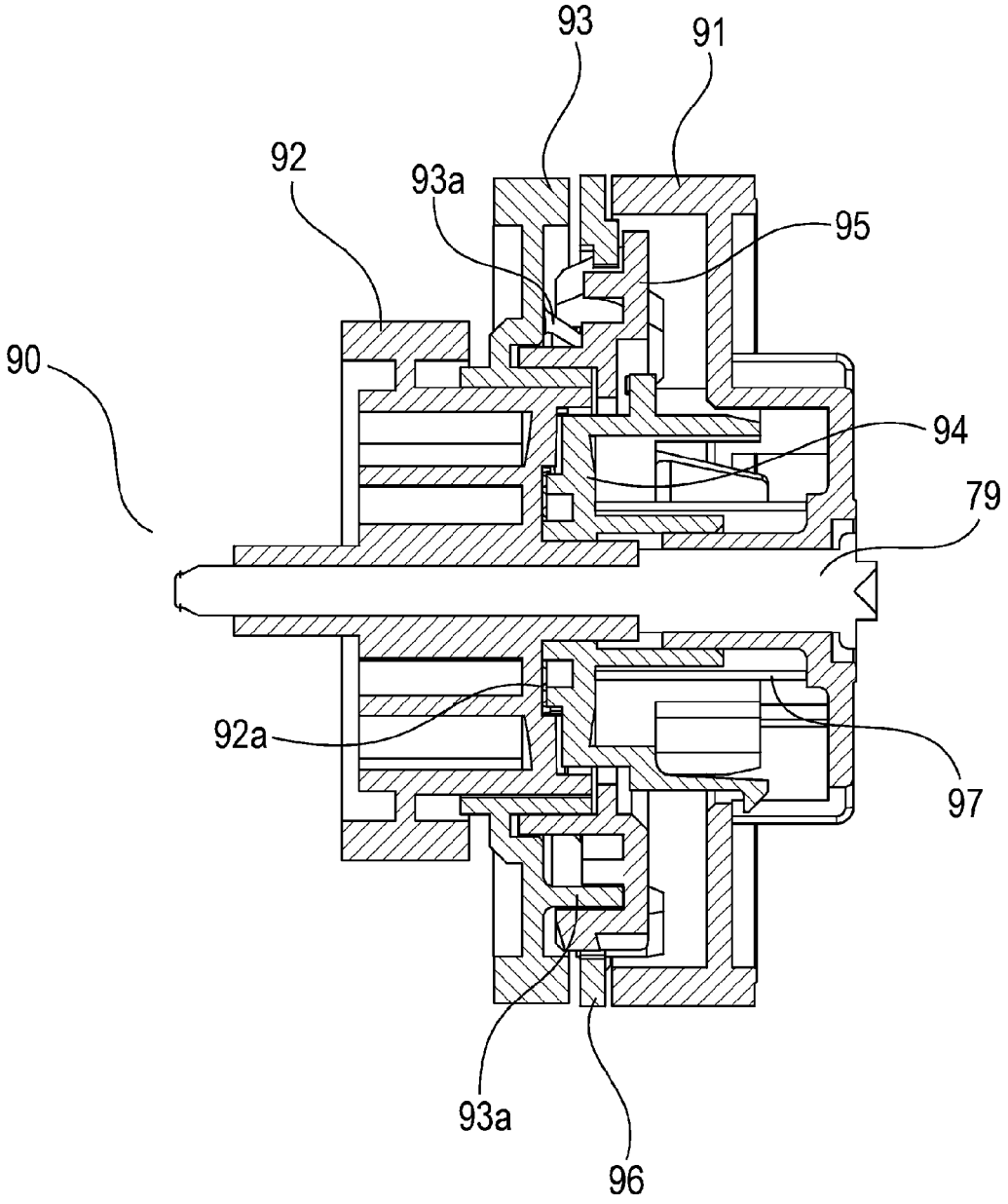

FIG. 6 is a sectional view of the mechanical clutching mechanism in the first embodiment, which is in the state of engagement.

Figure 7:
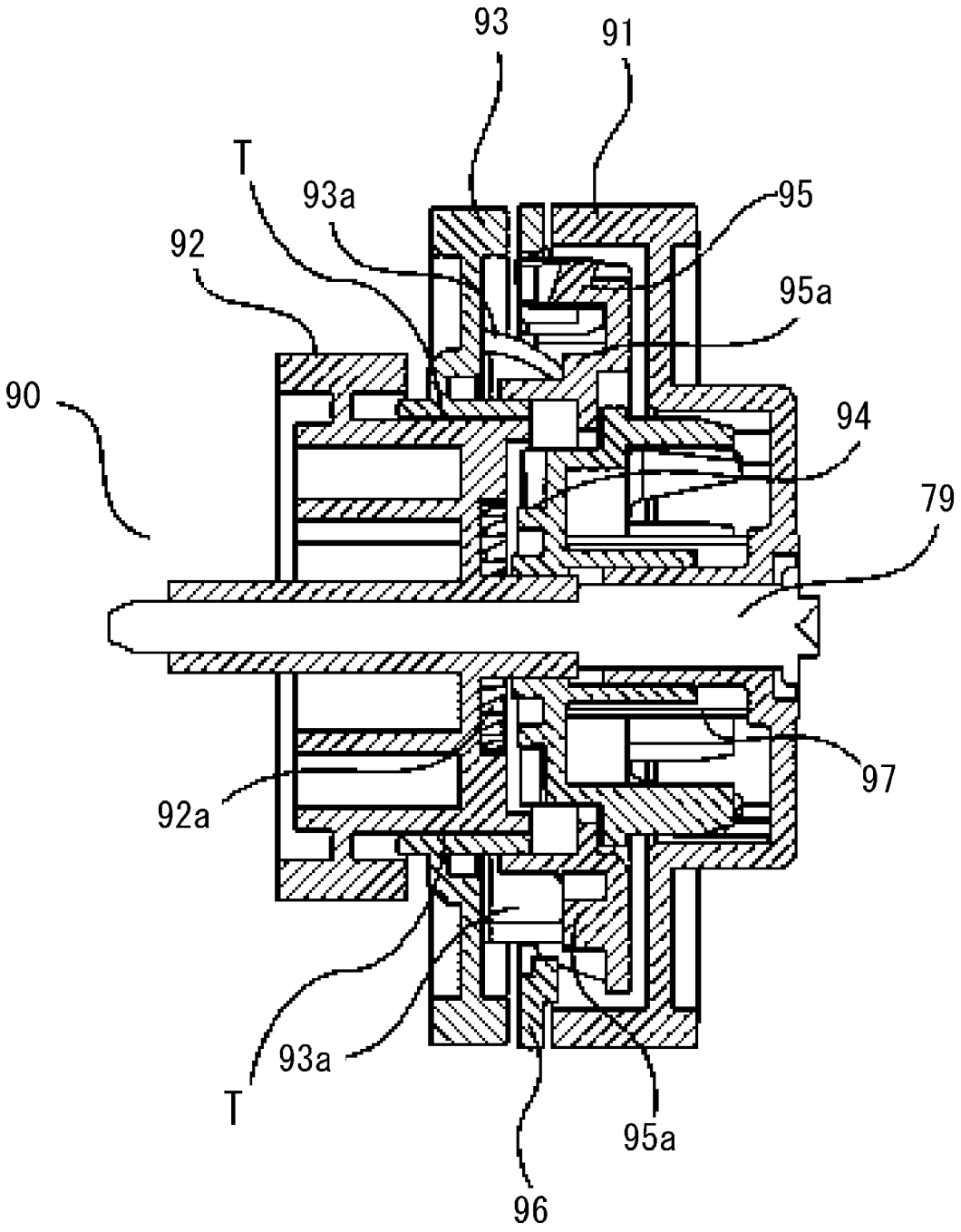

FIG. 7 is a sectional view of the mechanical clutching mechanism in the first embodiment, which is in the state of disengagement.

Figure 8:
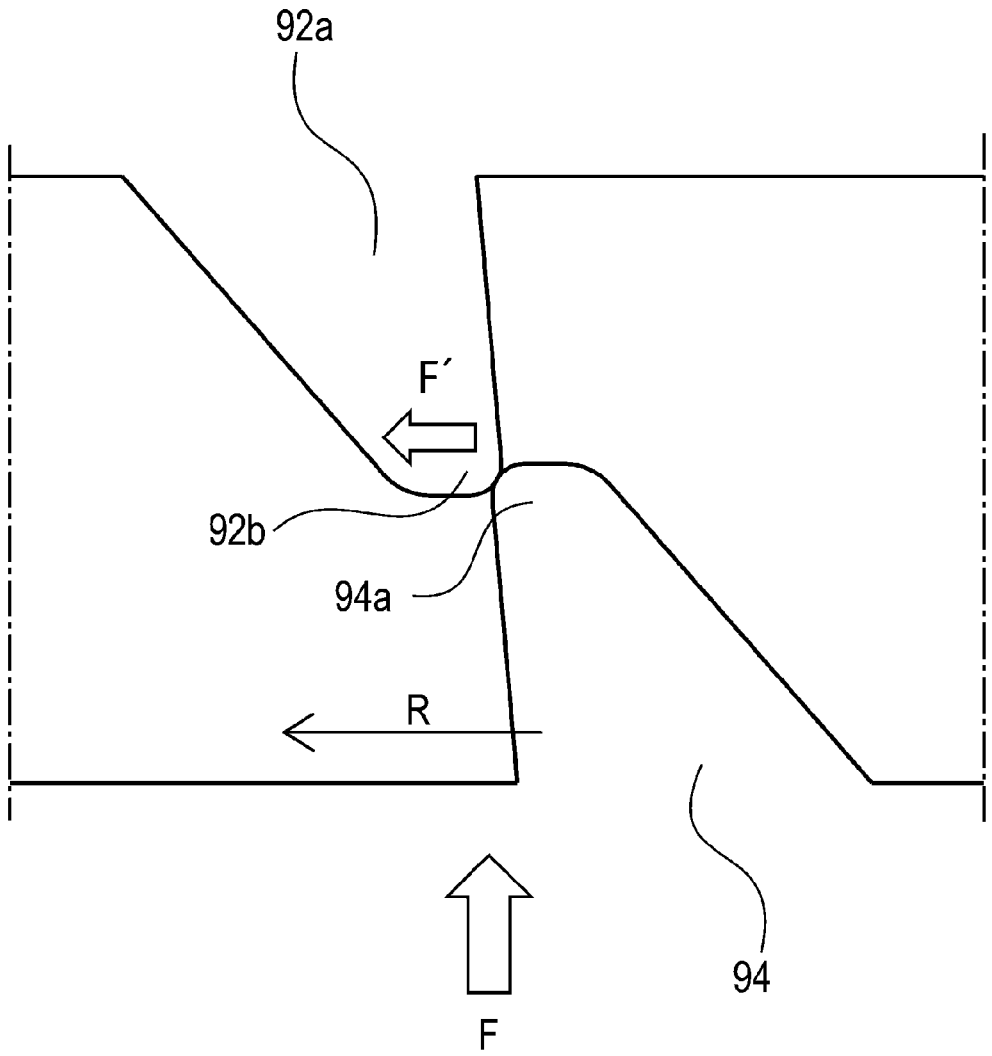

FIG. 8 is an enlarged view of the area of engagement of a comparative mechanical clutching mechanism, which is in the state of unsatisfactory engagement.

Figure 9:
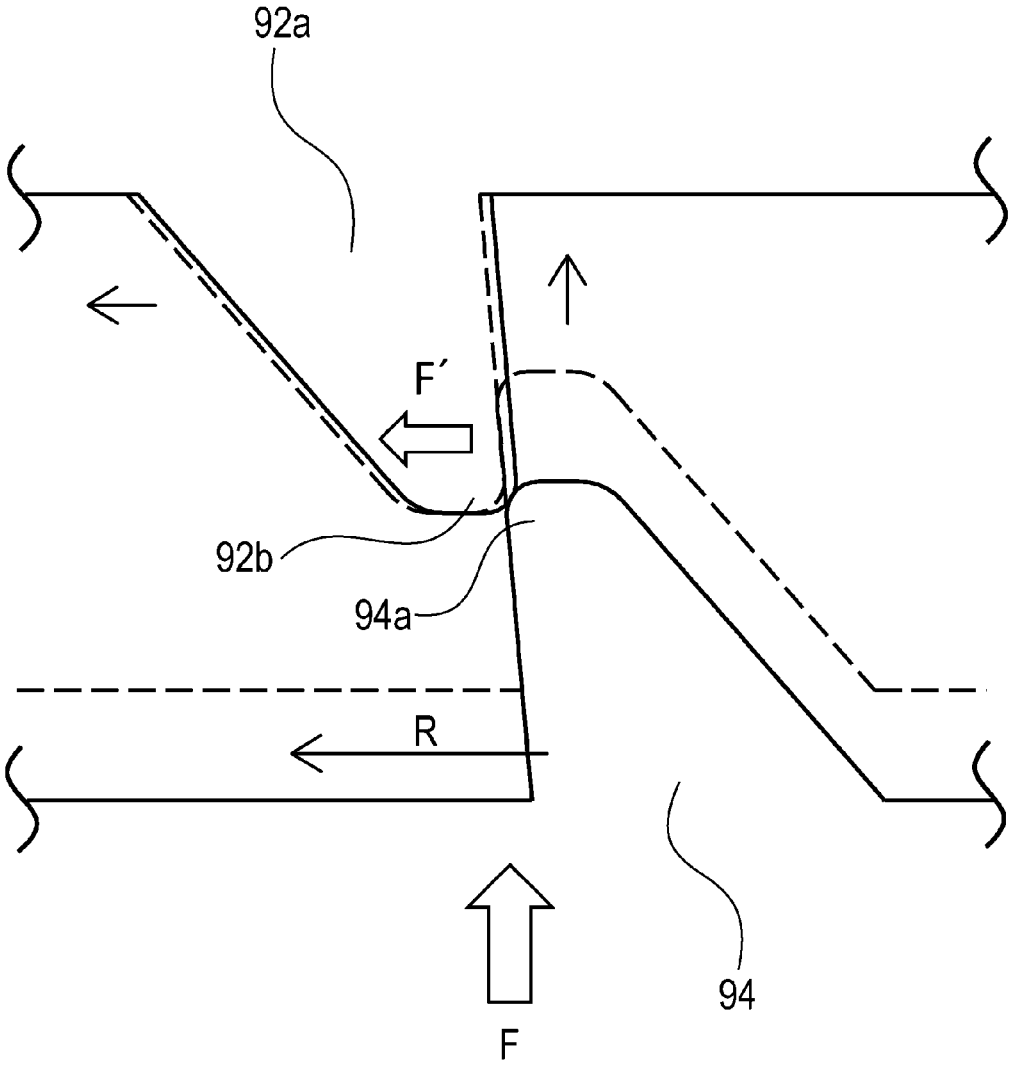

FIG. 9 is an enlarged view of the area of engagement of the mechanical clutching mechanism in the first embodiment.

Figure 10:
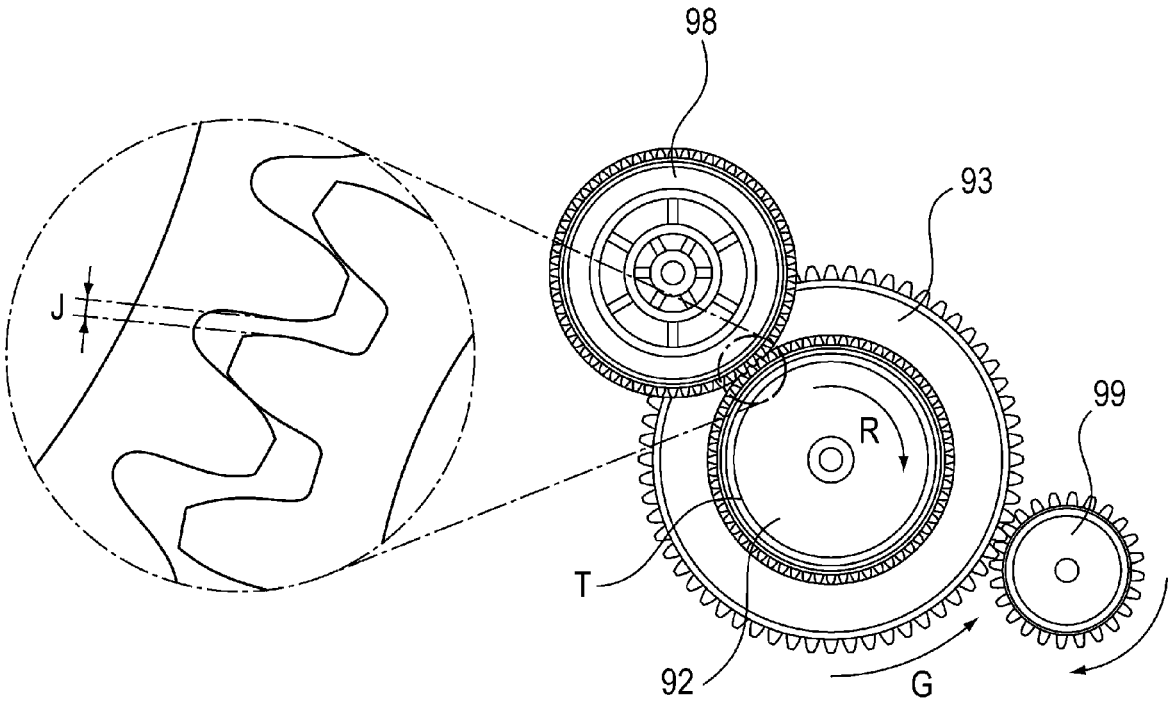

FIG. 10 is a drawing of the drive train of the mechanical clutching mechanism in the first embodiment.

Figure 11:
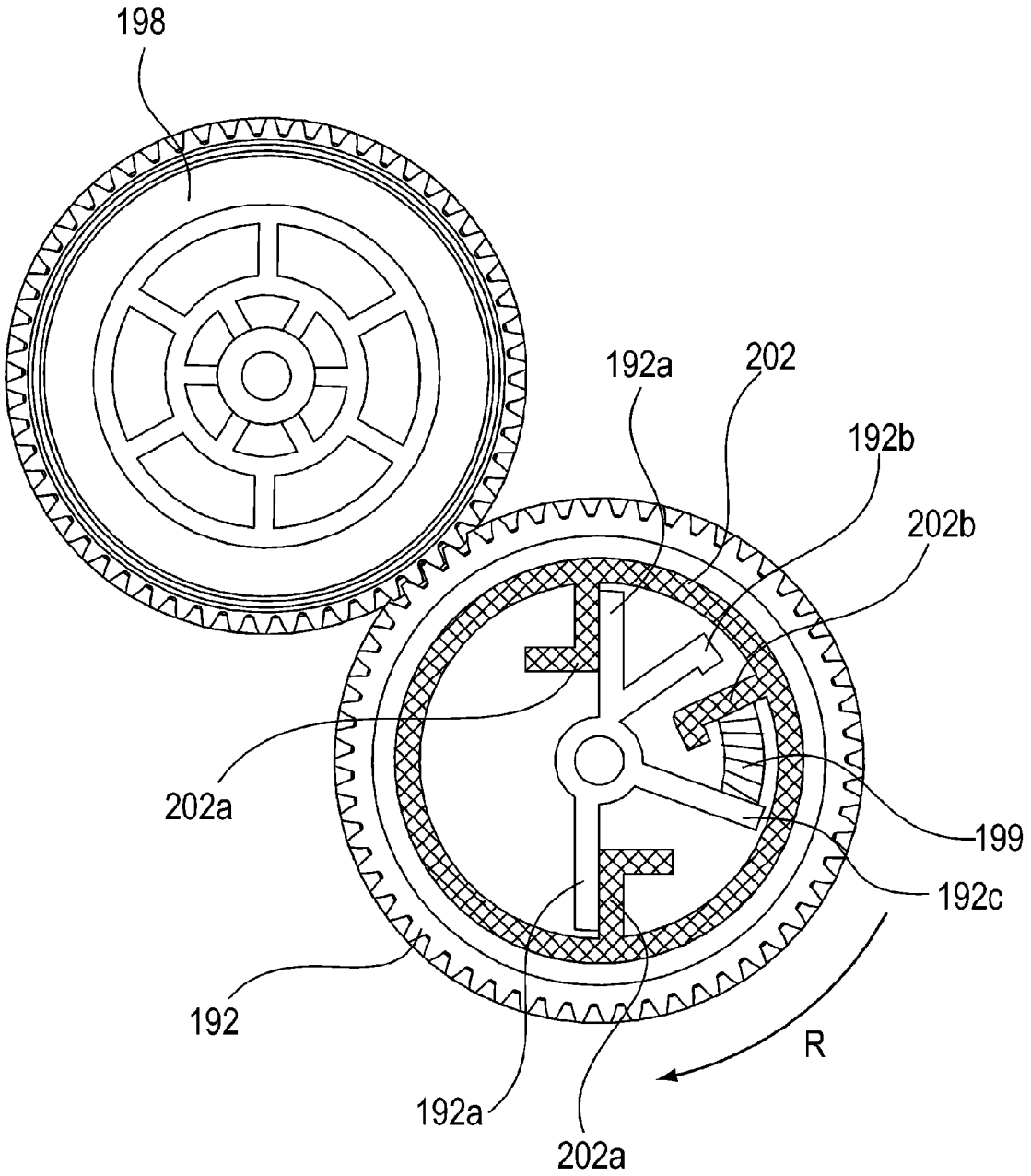

FIG. 11 is a drawing of a mechanical clutching mechanism in the second embodiment of the present invention, which is in the state in which driving force is transmitted.

Figure 12:
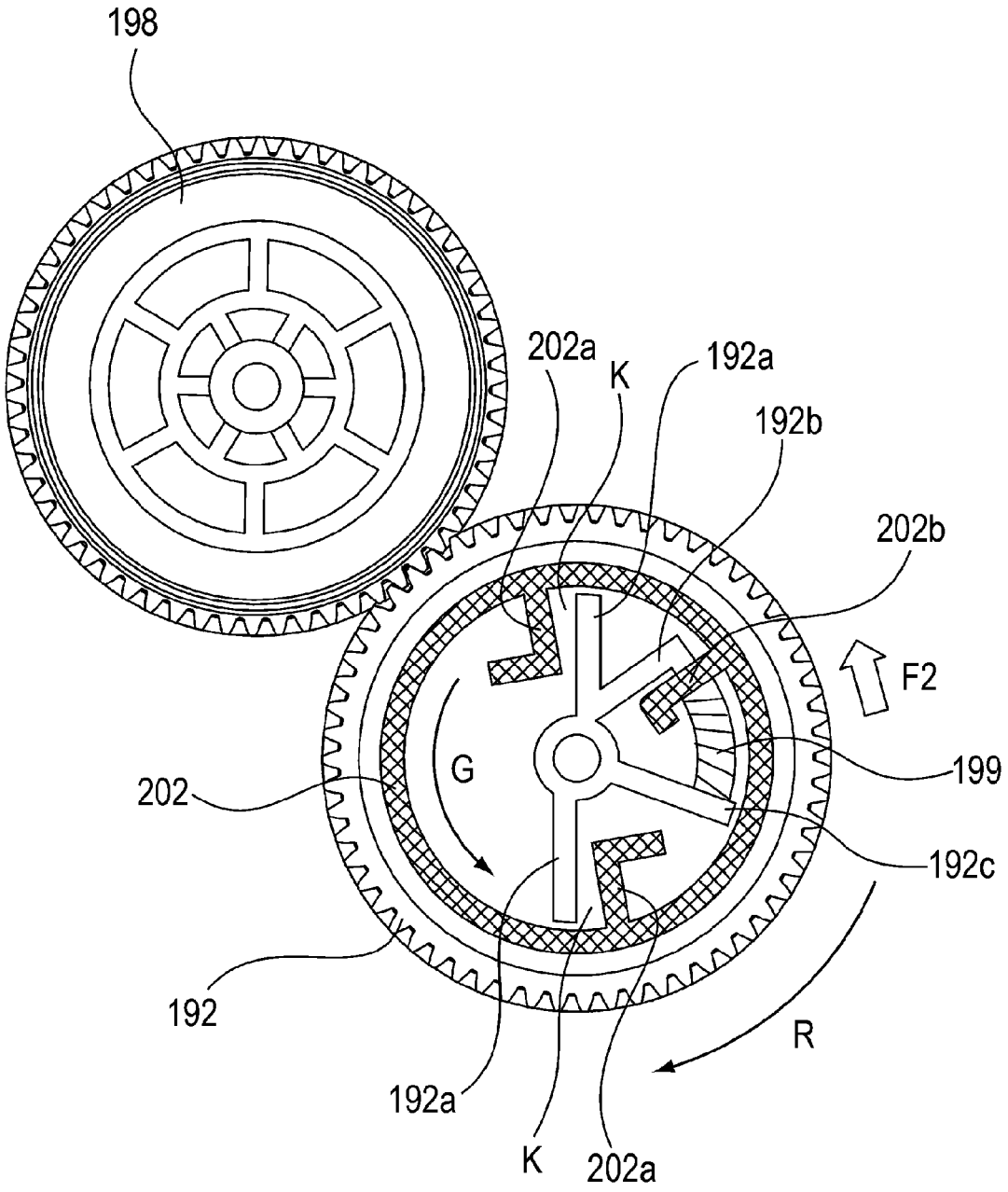

FIG. 12 is a drawing of a mechanical clutching mechanism in the second embodiment of the present invention, which is in the state in which driving force is not transmitted.

Figure 13:
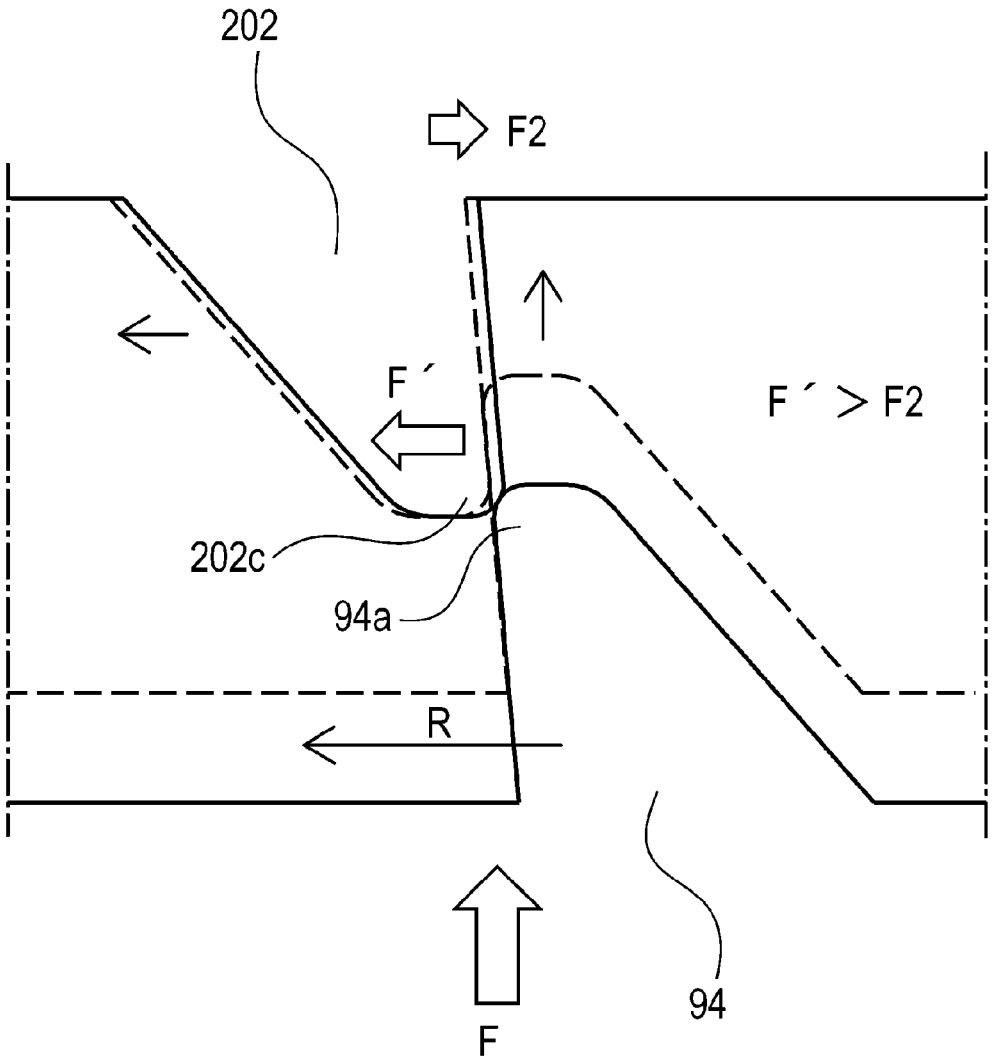

FIG. 13 is an enlarged view of the area of engagement in the mechanical clutching mechanism in the second embodiment.

DESCRIPTION OF THE EMBODIMENTS

The present invention is described in detail with reference to a few of the preferred embodiments of the present invention, referring to appended drawings. However, the measurements, materials, and shapes of the structural components of the driving devices and image forming apparatuses in the following embodiments of the present invention, and the positional relationship among the components, are not intended to limit the present invention in scope, unless specifically noted.

Embodiment 1

<Image Forming Apparatus>

Figure 1:
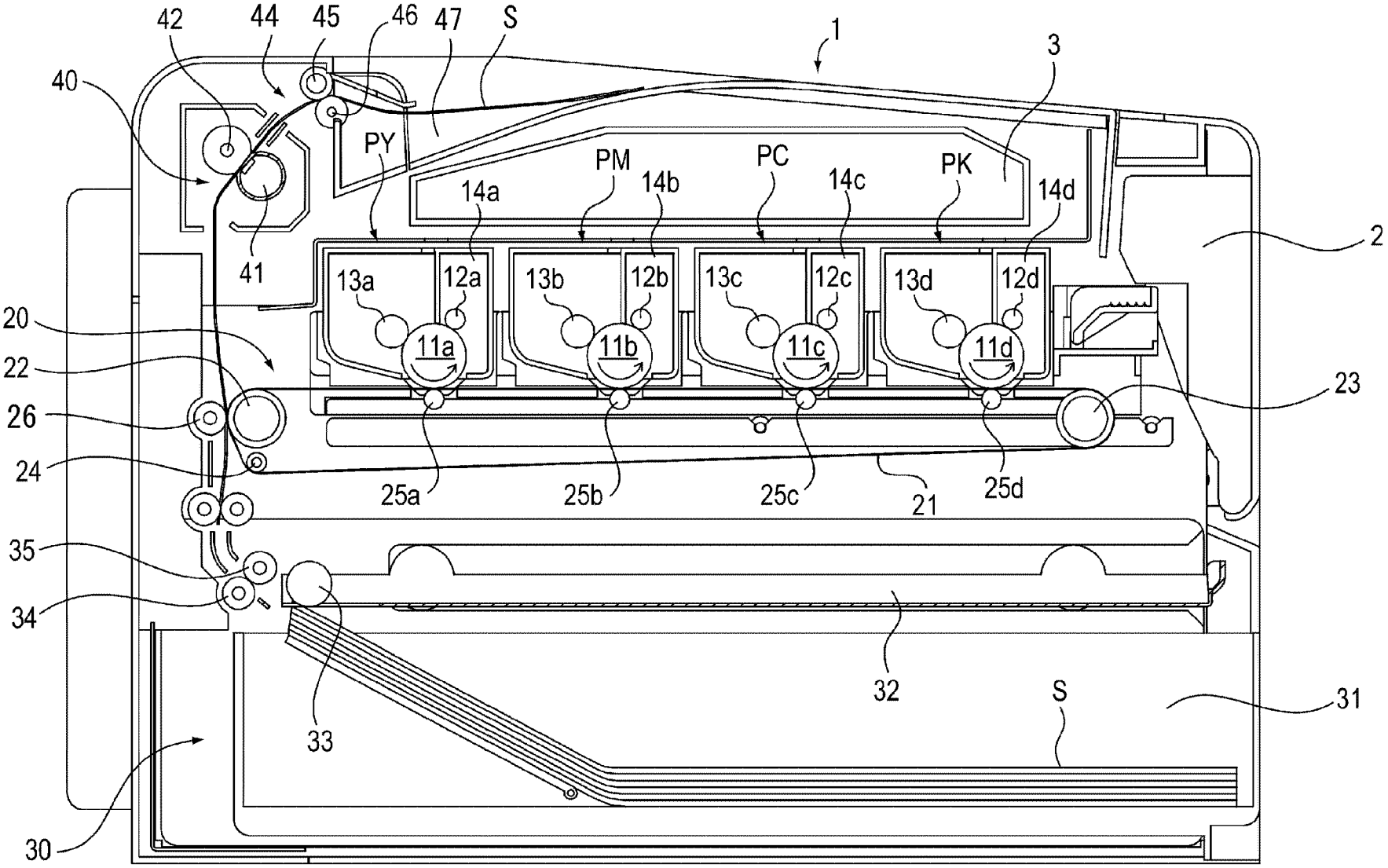
FIG. 1 is a sectional view of a typical image forming apparatus to which the present invention is applicable.

First, referring to FIG. 1, the image forming apparatus in the first embodiment of the present invention is described. Here, the image forming apparatus is described as a full-color laser beam printer, which is based on four primary colors, and employs an electrophotographic image processing method. By the way, FIG. 1 is a sectional view of the image forming apparatus 1 in this embodiment. It shows the general structure of the apparatus 1. In the following description of preferred embodiments of the present invention, the "front side" of the image forming apparatus 1 means the side which has a door 2 (member which can be opened or closed), and the "rear side" means the opposite side from the front side. Moreover, the "left and right sides" of the image forming apparatus 1 means the left and right sides of the image forming apparatus 1 when the image forming apparatus 1 is seen from the front side.

<Structure of Image Forming Apparatus>

The image forming apparatus 1 in this embodiment is a full-color laser beam printer. It is of the so-called inline type, and also, of the so-called tandem type. Referring to FIG. 1, in the image forming apparatus 1, four process cartridges PY, PM, PC and PK (which may be referred to simply as cartridges P, hereafter), which form yellow (Y), magenta (M), cyan (C) and black (K) toner images, respectively, are disposed in tandem in the listed order. Each of the cartridges PY, PM, PC and PK is provided with a frame, and an electrophotographic photosensitive drum 11 (11*a*, 11*b*, 11*c* and 11*d*, respectively) which is disposed in the frame. Further, it is provided with a charge roller 12 (12*a*, 12*b*, 12*c* and 12*c*, respectively), which is referred to simply as charge roller 12, hereafter, for uniformly charging the peripheral surface of the photosensitive drum 11. The charge roller 12 also is disposed in the frame of each cartridge. Also disposed in the frame of the cartridge P is a developing device for developing an electrostatic latent image formed on the photosensitive drum 11. Each developing device is provided with a development roller 13 (13*a*, 13*b*, 13*c* and 13*d*, respectively), which is referred to simply as developing device, hereafter). In each developing device, developer (toner) is stored. Also disposed in the frame of the cartridge P is a cleaning device 14 (14*a*, 14*b*, 14*c* and 14*d*, respectively) for removing the residual toner remaining on the peripheral surface of the photosensitive drum 11.

Above the area in which the cartridges P are disposed, a laser scanner unit 3 is disposed. This laser scanner unit 3 scans (exposes) the peripheral surface of each photosensitive drum 11, by outputting a beam of laser light while modulating the beam with the inputted information of the image to be formed. As a result an electrostatic latent image is formed on each photosensitive drum 11.

Below the area in which the cartridges P are disposed, an intermediary transfer belt unit 20 (which hereafter will be referred to simply as belt unit) is disposed. This belt unit 20 is equipped with an endless belt 21 (which hereafter will be referred to simply as belt), which functions as an intermediary transferring member. The belt 21 is dielectric and flexible. Further, the belt unit 20 is provided with a driving roller 22, a turn roller 23, and a tension roller 24, which are for circularly moving the belt 21 while suspending and tensioning the belt 21. On the inward side of the loop (belt loop) which the belt 21 forms, four primary transfer rollers 25*a*, 25*b*, 25*c* and 25*d* are disposed in a manner to oppose the photosensitive drums 11*a*, 11*b*, 11*c* and 11*d*, respectively, with the presence of the top portion (with reference to belt loop) of the belt 21 between the primary transfer rollers 25 and photosensitive drums 11, one for one. Further, the image forming apparatus 1 is provided with a secondary transfer roller 26, which is disposed in a manner to oppose the driving roller 22, with the presence of the belt 21 between itself and driving roller 22.

The cartridges P, laser scanner unit 3, belt unit 20, primary transfer rollers 25*a*, 25*b*, 25*c* and 25*d*, and secondary transfer roller 26 are the primary structural members of the image forming portion which forms an unfixed toner image on recording medium.

Below the belt 21, there is provided a sheet feeding portion 30 which feeds recording medium such as sheet S of paper into the main assembly of the image forming apparatus 1. The sheet feeding portion 30 has: a sheet cassette 31 in which blank sheets S of recording medium are stored in layers; and a sheet passage 32, through which a manually fed sheet S of recording medium is conveyed. Further, the sheet feeding portion 30 has: a feed roller 33 which feeds a sheet S of recording medium into the main assembly of the image forming apparatus 1; a separation roller 34 which separates the topmost sheet S from the rest in the sheet cassette 31; and a sheet conveyance roller 35 which conveys the sheet S downstream. By the way, the image forming apparatus 1 is structured so that the sheet cassette 31 and sheet passage 32 are removably installable into the image forming apparatus 1 from the front side of the apparatus 1.

Moreover, the image forming apparatus 1 is provided with a fixing apparatus 40 for fixing the unfixed toner image on a sheet S of recording medium to the sheet S. The fixing apparatus 40 is on the downstream portion of the image forming apparatus 1 in terms of the direction in which the sheet S is fed into the main assembly of the image forming apparatus 1 by the sheet feeding portion 30. Further, the image forming apparatus 1 is provided with a pair of discharge rollers 44 for discharging the sheet S out of the image forming apparatus 1 after the fixation of the toner image to the sheet S by the fixing apparatus 40, and a delivery tray 47 in which the sheets S are accumulated in layers as they are discharged. By the way, the pair of discharge rollers 44 comprise a discharge roller 45 and an idler roller 46.

The fixing apparatus 40 is provided with a pressure roller 42 which is rotated by the driving force transmitted thereto from the main assembly of the image forming apparatus 1, and a heating unit 41. The pressure roller 42 and heating unit 41 form a fixation nip, in which a sheet S of recording medium remains sandwiched by the pressure roller 42 and heating unit 41 while the sheet S is conveyed through the fixing apparatus 40.

<Image Forming Operation>

Each photosensitive drum 11 is rotationally driven in the direction indicated by an arrow mark in the drawing, at a preset speed. The belt 21 also is rotationally driven. More specifically, it is rotationally driven at the same speed as the photosensitive drum 11 in such a direction that in the area in which the belt 21 opposes the photosensitive drum 11, the belt 21 moves in the same direction as the peripheral surface of the photosensitive drum 11. The sheet feeding portion 3 also is driven with roughly the same timing. In synchronism with the driving of these components, the charge roller 12 uniformly changes the peripheral surface of the corresponding photosensitive drum 11 to preset polarity and potential level, with preset control timing, in each cartridge P. The laser scanner unit 3 scans (exposes) the peripheral surface of each photosensitive drum 11, with the beam of laser light which it outputs while modulating the beam with image formation signals. Consequently, the points of the peripheral surface of the photosensitive drum 11, which were scanned by (exposed to) the beam of laser light, reduce in potential. As a result, an electrostatic latent image is effected on the peripheral surface of each photosensitive drum 11. Then, the electrostatic latent image on the peripheral surface of each photosensitive drum 11 is developed into a toner image by the development roller 13 in each cartridge P. Through the image formation process described above, four unfixed monochromatic toner images, which are different in color, are formed in layers on the belt 21.

Meanwhile, the sheets S of recording medium in the sheet cassette 31 are fed one by one into the main assembly of the image forming apparatus 1 by a combination of a separation roller 34 and a sheet conveyance roller 34 with preset timing. Then, the unfixed toner images on the belt 21 are transferred onto the sheet S while the sheet S is conveyed through the transfer nip between the transfer roller 26 and belt 21. Thereafter, the sheet S is separated from the surface of the belt 21, and sent to the fixing apparatus 40. Then, the sheet S is heated and pressed in the fixation nip. As a result, the unfixed toner images on the sheet S, which are different in color, become fixed to the sheet S while being mixed. After the sheet S is moved out of the fixing apparatus 40, it is discharged onto a delivery tray 47 by a pair of discharge rollers 44.

<Driving Device>

Figure 2:
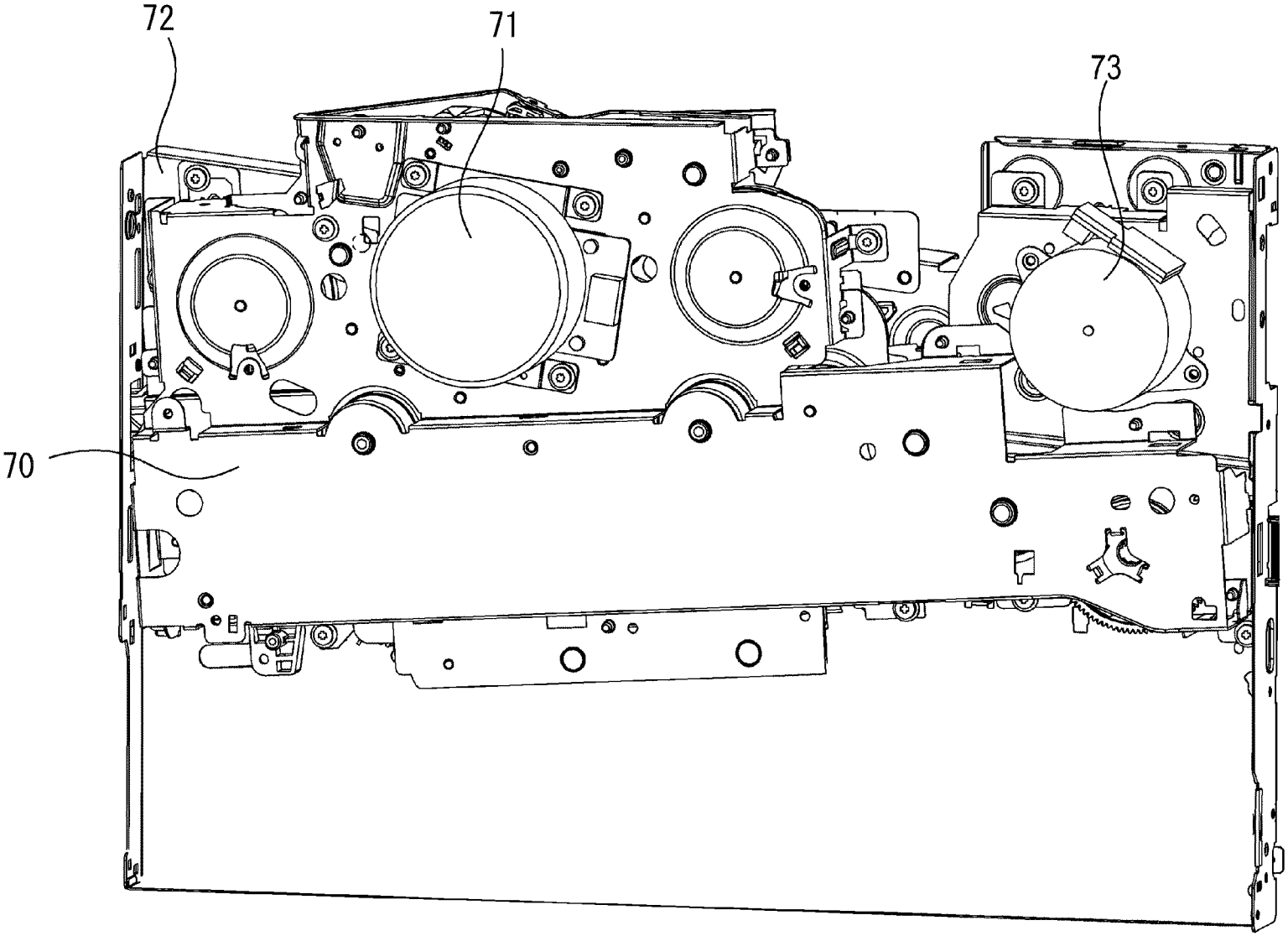
FIG. 2 is a perspective view of a combination of the main frame of an image forming apparatus, and the driving device of the image forming apparatus, which is attached to the main assembly.
Figure 3:
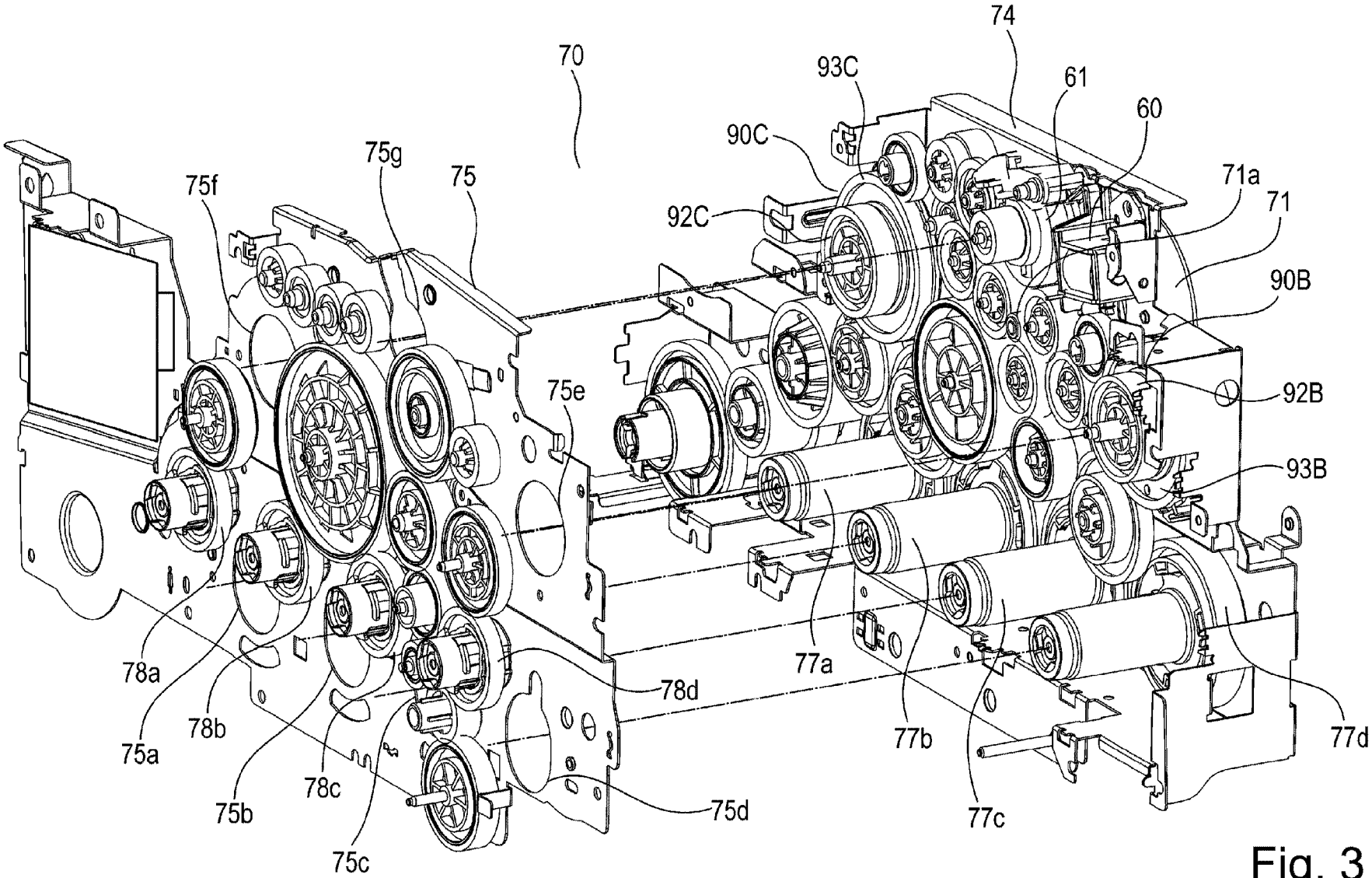
FIG. 3 is a perspective view of a typical driving device for an image forming apparatus.
Figure 4:
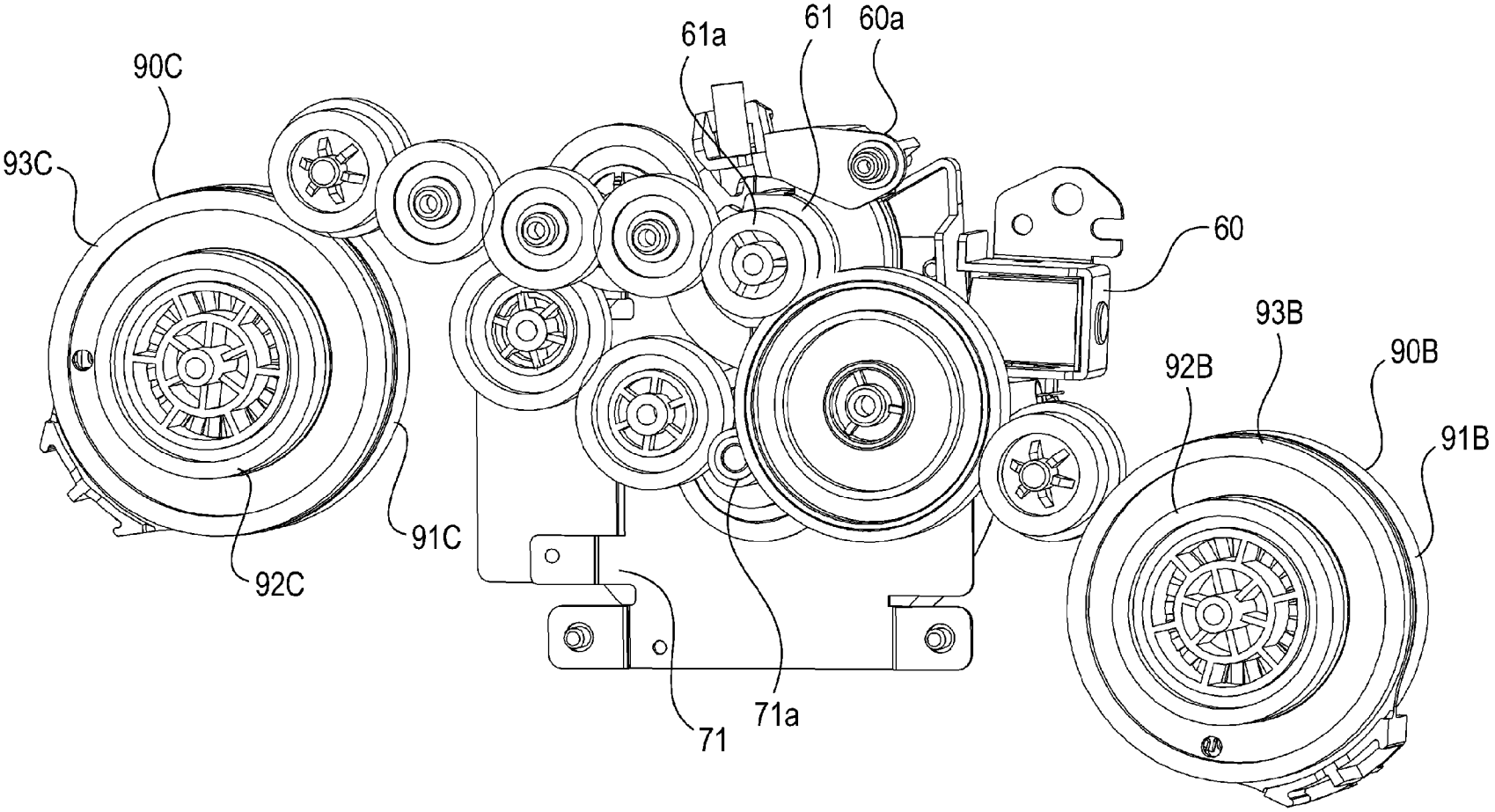
FIG. 4 is a perspective view of a development roller drive train of the driving device.

Next, referring to FIGS. 2, 3 and 4, the driving device 70 of the image forming apparatus 1 described above is described about its structure.

FIG. 2 is a perspective view of the driving device 70, as seen from the outward side of the main assembly of the image forming apparatus 1 after the attachment of the driving device 70 to the main assembly. In FIG. 2, only the right-hand external plate of the frame of the main assembly of the image forming apparatus 1, and the driving device 70, are shown, for the sake of simplification. FIG. 3 is an exploded perspective view of the driving device 70. FIG. 4 is a perspective view of the development roller drive train of the driving device 70.

The driving device 70 has: the main motor 71 as a driving force source; a fixation motor 73; and gear trains for transmitting the rotational forces outputted by the motors 71 and 73. The driving force outputted by the main motor 71 which is a driving force source is transmitted by the internal gear trains of the driving device 70 to rotationally drive the four photosensitive drums 11, four development rollers 13, driving roller 22 of the belt unit 20, and also, an unshown mechanism for placing the development rollers 13 in contact with the photosensitive drums 11, one for one, or separating the development rollers 13 from the corresponding photosensitive drums 11. As for the fixation motor 73, the rotational force outputted by the fixation motor 73 is transmitted by one of the internal gear trains of the driving device 70 to drive the pressure roller 42 of the fixing apparatus 40.

By the way, here, the gear train for driving the driving gear 22 of the belt unit 20, gear train for driving the pressure roller 42, and gear train for driving the mechanism for placing the development rollers 13 in contact with the corresponding photosensitive drums 11, or separating the development rollers 13 from the corresponding photosensitive drums 11 are not described in detail.

First, referring to FIGS. 3 and 4, the drum gear train which transmits the rotational force outputted from the main motor 71, to the four photosensitive drums 11, and the development gear train which transfers the rotational force outputted from the main motor 71 to the four development rollers 13, are described.

The drum gear train of the driving device 70 shown in FIG. 3 transmits the rotational force outputted from the main motor 71, to four drum gears 77 (77*a*, 77*b*, 77*c* and 77*d*), by way of a motor gear 71*a* on the motor shaft, and a gear train comprising multiple gears. Each of the four drum gears 77 (77*a*, 77*b*, 77*c* and 77*d*) is provided with a coupling which couples with the coupling (unshown) with which the shaft of the photosensitive drum 11 is provided. As the cartridge is installed into the image forming apparatus 1, the coupling on the shaft of the photosensitive drum 11 in the cartridge couples with the coupling of the drum gear 77 of the driving device 70. As the rotational force outputted from the main motor 71 is transmitted to the photosensitive drum 11 in the cartridge by way of the aforementioned drum gear train, the photosensitive drum 11 is rotated. By the way, the coupling portions of the four drum gears 77 with which the first driving frame 74 is provided, are inserted into the four holes 75*a*, 75*b*, 75*c* and 75*d*, respectively, with which the second driving frame 75 is provided.

Also referring to FIGS. 3 and 4, the development gear train of the driving device 70 branches from the motor gear 71*a*, into the gear train for color (yellow, magenta and cyan) image formation side, and the gear train for black image formation side. Of the development gear trains, the gear trains on the color side which branch from the motor gear 71*a* are in connection to the development gears 78*a*, 78*b*, 78*c* and 78*d*, by way of the clutch 90*c* on the color side, and the downstream gear train which is in connection to the clutch 90*c*. Further, of the development gear train, the gear train on the black side, which branches from the motor gear 71*a*, is in connection to the development gear 78*d*, by way of the clutch 90B on the black side, and the downstream gear train which is in connection to the clutch 90B. Each of the four development gears 78*a*, 78*b*, 78*c* and 78*d* is provided with a coupling, which couples with the coupling (unshown), with which the shaft of the corresponding development roller is provided. As the cartridge is installed into the main assembly of the image forming apparatus 1, the coupling on the development roller shaft in the cartridge is coupled with the coupling of the development gear 78 of the driving device 70. As the rotational force outputted from the main motor 71 is transmitted to the development roller in the cartridge, by way of the aforementioned development gear train, the development roller is rotated by the transmitted force. By the way the clutch 90C on the color side, with which the first driving frame 74 is provided, is inserted into a hole 75*f*, with which the second driving frame 75 is provided, and is connected to the aforementioned downstream gear train which is connection to the development gears 78*a*, 78*b*, 78*c* and 78*d*, with which the second driving frame 75 is provided. Further, the clutch 90B on the black side, with which the second driving frame 75 is provided is inserted into a hole 75*e*, and is connected to the aforementioned downstream gear train which is in connection to the development gear 78*d* with which the second driving frame 75 is provided.

By the way, regarding the above-mentioned development gear train, the rotational force transmitted from the main motor 71 to each of the clutches 90B and 90C is transmitted, or not transmitted, to the development gear on the downstream side of the clutches 90B and 90C, by the turning on, or off, of the clutches 90B and 90C, respectively.

That is, by disengaging the clutches 90B and 90C, it is possible to stop the rotational force from being transmitted to the four development rollers, even while the main motor 71 rotates.

On the other hand, when the clutch 90C on the color side is in the state of engagement, the rotational force outputted from the main motor 71 is transmitted to the development gears 78*a*, 78*b* and 78*d*, whereby the development rollers on the color side are rotated. Further, when the clutch 90B of the black side is in the state of engagement, the rotational force outputted from the main motor 71 is transmitted to the development gear 78*d* by way of the clutch 90B, whereby the development roller on the black side is rotated.

The clutches 90B and 90C are engaged or disengaged by a combination of a solenoid 60 and a W missing-teeth gear 61, shown in FIG. 4. This operation is described later. By the way, the W missing-teeth gear 61, with which the first driving frame 74 is provided, is inserted into the hole 75*g* (FIG. 3), with which the second driving frame 75 is provided, and is in connection to the gear train which is in connection to the clutch 90B on the black side. The gear train which is in connection to the clutch 90C on the color side, and the gear train which is in connection to the clutch 90B on the black side, are attached to the second driving frame 75 (FIG. 3).

Next, referring to part (a) of FIGS. 5, 5(*b*), 6 and 7, the clutches 90B and 90C of the driving device 70 are described about their structure. The clutch 90B is a part of the gear train which connects the main motor 71 to the development roller on the black side, and the clutch 90C is a part of the gear train which connects the main motor 71 to the clutch 90C on the color side. The clutches 90B and 90C are clutching means for allowing the rotational force outputted from the main motor 71 to be transmitted, or not transmitted, to the development rollers. They are the same in structure except for the shape of their cam-like portion. Therefore, referential codes B and C are not shown in the description of the clutches 90B and 90C. That is, both the clutches 90B and 90C are described as a clutch 90. Further, the various members of the clutches are also described without the referential codes B and C.

Referring to part (a) of FIGS. 5 and 5(*b*), the clutch 90, which is a clutching means, comprises a driving gear 91, a gear 92 to be driven by the driving gear, a cam gear 93, an engaging portion 94 (first engaging member) on the driving side, a disengaging member 95, a rotation stopper 96, and a compression spring 97.

The gear 92, which is a member to be driven by the driving gear 91, and therefore, is referred to as "follower gear" hereafter, is rotationally supported by a shaft 79 crimped to the first driving frame 74 (FIG. 3). The driving gear side of the follower gear 92 is provided with a second engaging portion 92*a*. The second engaging portion 92*a*, which is an engaging portion of the follower gear 92, is rotatable about the shaft 79. It is rotated by the rotation of the first engaging member 94 by engaging with the first engaging member 94. The second engaging portion 92*a*, is enabled to be in such a state that it is in engagement with the first engaging member 94, and therefore, the driving force from the main motor 71 (FIG. 3) is not transmitted to the second engaging portion 92*a*, or in such a state that it is in engagement with the first engaging member 94, and therefore, it is rotated by the driving force from the main motor 71 (FIG. 3) about the shaft 79. Here, the driving device 70 is structured so that the second engaging portion 92*a* moves with the follower gear 92. Therefore, the follower gear 92, which is a gear to be driven by the driving gear 91, rotates with the second engaging portion 92*a* about the shaft 79.

A clutch cam gear 93, which is a rotational member, engages with the peripheral surface of the second engaging portion 92*a* of the follower gear 92. It is supported in such a manner that it can rotate about the follower gear 92. The clutch cam gear 93 is provided with a cam-like portion 93*a* having a slant surface which is slant in such a manner that the more upstream it is in terms of the direction of the rotation of the clutch cam gear 93, which is indicated by the arrow mark R, the closer the slant surface is to the driving gear 91. The cam-like portion 93*a*, which is the first cam, engages with a cam-like portion 95*a* with which the clutch disengaging member 95 is provided.

The clutch disengaging member 95 has a portion 95*b*, which engages with the engaging portion 96*a* of the stopper 96 fixed to the first engaging member 94, in such a manner that it is regulated in its rotational movement relative to the engaging portion 96*a*, but, is allowed to move in the direction parallel to the shaft. The clutch disengaging portion 95 is provided with a cam-like portion 95*a* which faces the cam-like portion 93*a* of the clutch cam gear 93, and has such a slant surface that the more downstream it is in terms of the direction of the rotation of the clutch cam gear 93, which is indicated by the arrow mark R, the closer the slant surface is to the clutch cam gear 93. The cam-like portion 95*a*, which is the second cam, engages the cam-like portion 93*a* of the clutch cam gear 93.

The driving device 70 has: the clutch driving gear 91 as a driving member; first engaging member 94, and a compression spring 97 as a pressing member. The clutch driving gear 91 is rotatably supported by the shaft 79 crimped to the first driving frame 74. The driving gear 91 rotates about the shaft 79 by receiving the driving force outputted from the main motor 71. Not only is the first engaging member 94 enabled to move relative to the driving gear 91 in the direction parallel to the shaft, but also, to rotate about the shaft 79 with the driving gear 91 which is being prevented from moving in its rotational direction. Between the driving gear 91 and first engaging member 94, the compression spring 97 as a pressure applying member, is disposed. The first engaging member 94 is under the pressure generated by the compression spring 97 in the direction to engage with the second engaging portion 92*a* of the follower gear 92.

Therefore, the transmission of the driving force inputted into the driving gear 91 of the clutch 90 structured as described above, to the follower gear 92, and the stopping of the transmission, are as follows:

As the driving force is inputted into the driving gear 91, it is transmitted to the first engaging member 94 which is in engagement with the driving gear 91 and rotates with the driving gear 91. Then, as the engaging portion 94 engages with the second engaging portion 92*a* of the follower gear 92, the driving force is transmitted to the follower gear 92.

On the other hand, as the clutch cam gear 93 is rotated, and therefore, the cam-like portion 93*a* of the clutch cam gear 93 engages with the cam-like portion 95*a* of the clutch disengaging portion 95, the clutch disengaging portion 95 is moved in the direction parallel to the shaft. During this movement, the clutch disengaging portion 95 is moved in the direction to separate from the clutch cam gear 93 in the shaft direction, while remaining regulated in its movement in its rotational direction by the rotation stopper 96. Thus, the engaging portion 94 which is in engagement with the clutch disengaging portion 95, separates from the second engaging portion 92*a* of the follower gear 92 while compressing the compression spring 97 which is between the driving gear 91 and engaging portion 94. Consequently, the clutch 90 is disengaged. As the driving gear 91, engaging portion 94, and second engaging portion 92*a* of the follower gear 92 become disengaged from each other as shown in FIG. 7, the transmission of the driving force inputted into the driving gear 91, to the follower gear 92, is stopped.

By the way, the state in which the driving force inputted into the driving gear 91 is transmitted to the follower gear 92 is such a state that the clutch 90 is remaining engaged. On the other hand, the state in which the driving force inputted into the driving gear 91 is not transmitted to the follower gear 92 is such a state that the clutch 90 is remaining disengaged.

Here, engaging and disengaging of the clutch 90 are described. The clutch 90 is engaged or disengaged by the combination of the solenoid 60 and W missing-teeth gear 61 shown in FIG. 4. The combination of the solenoid 60 and W missing-teeth gear 61 is a controlling means for rotating the cam gears 93B and 93C, which are rotational members which the clutches 90B and 90C have, respectively.

The W missing-teeth gear 61 comprises a missing-teeth gear (unshown) which can mesh with a gear of the gear train for transmitting the driving force from the main motor 71, and a gear 61*a* which meshes with one of the gears of the gear train for transmitting the driving force to each of the clutches 90B and 90C. It is structured so that the missing-teeth gear and gear 61*a* are on the same shaft. The W missing-teeth gear 61 is in engagement with an arm 60*a*, which is pivotally movable into the unshown disengagement position by the transmission of electric power to the solenoid 60, at a position which the toothless portion of the unshown missing-teeth gear faces one of the gear of the gear train from the main motor 71. The W missing-teeth gear 61 is provided with a spring which is positioned between the gear 61*a* and missing-teeth gear (unshown) to keep the missing-teeth gear pressured in the rotational direction.

As the solenoid 60 is supplied with electric power, the arm 60*a* is pivotally moved to the disengagement position shown in FIG. 4, whereby the missing-teeth gear (unshown) of the W missing-teeth gear 61 is disengaged. As a result, the missing-teeth gear is rotated by the resiliency of the spring, being thereby made to mesh with one of the gear of the gear train from the main motor 71. Thus, the driving force from the main motor 71 is transmitted to the gear 61*a*, and then, its transmitted to the gear trains of the clutches 90B and 90C by way of the W missing-teeth gear 61. As the W missing-teeth gear 61 is rotated, the toothless portion of the unshown missing-teeth gear of the W missing-teeth gear 61 faces one of the gears of the gear train from the main motor 71. Consequently, the meshing of the W missing-teeth gear 66 is dissolved. That is, as the W missing-teeth gear 61 is rotated, the transmission of the rotational force from the main motor 71 is stopped. By the way, as the arm 60*a* is pivotally moved to the disengagement position shown in FIG. 4, by the electric power supplied to the solenoid 60, the power is stopped with preset timing. Thus, it is engaged with the W missing-teeth gear 61, the toothless portion of the missing-teeth gear of which is facing one of the gears of the gear train from the main motor 71.

As electric power is sent to the solenoid 60, and therefore, the W missing-teeth gear 61 is rotated, the driving force from the main motor 71 is transmitted to the cam gear 93C of the clutch 90C on the color side, and the clutch 90B of the black side, by way of the gear train which is in connection to the gear 61*a* of the W missing-teeth gear 61. The tooth counts of the cam gears 93B and 93C are set so that as the W missing-teeth gear 61 is rotated once, the W missing-teeth gear 61 rotates ⅓ a rotation. The clutches 90C and 90B are engaged or disengaged by the solenoid 60 alone. Therefore, they synchronously rotate.

Next, the change in the state of the clutch 90 from the one in which the clutch 90 remains engaged, and the one in which the clutch 90 remains disengaged is described.

As described above, as electric power is sent to the solenoid 60 (FIG. 4), the driving force from the main motor 71 (FIG. 3) is transmitted to the clutch cam gear 93, and therefore, the clutch cam gear 93 is rotated. As the clutch cam gear 93 is rotated, the slant surface of the cam-like portion 93*a* of the clutch cam gear 93 engages with the slant surface of the cam-like portion 95*a* of the clutch disengaging portion 95. As the clutch cam gear 93 is further rotated, clutch disengaging portion 95 is moved in the direction to separate from the clutch cam gear 93, by the engagement between the cam-like portions 93*a* and 93*g*. Thus, the first engaging member 94 which is in engagement with the clutch disengaging portion 95 is moved in the direction parallel to the shaft against the force generated by the compression spring 97. The first engaging member 94 is moved relative to the second engaging portion 92*a* of the follower gear 92, in the direction to be separated from the clutch cam gear 93. Therefore, the area of contact between the slant surfaces of the cam-like portions 93*a* and 95*a* reduces in size. As the clutch cam gear 93 is rotated ⅓ a turn, the rotation of the clutch cam gear 93 is stopped, and the clutch cam gear 93 and clutch disengaging portion 95 are kept in a state in which the flat surface provided on the downstream side of the slant surface of the cam-like portion 93*a* in terms of the rotational direction R, remains engaged with the flat surface provided on the downstream side of the slant surface of the cam-like portion 95*a* in terms of the opposite direction G from the rotation direction indicated by the arrow mark R. Thus, the first engaging member 94 is completely retracted from the second engaging portion 92*a* of the follower gear 92, becoming separated from the second engaging portion 92*a*.

Next, the change in the state of the clutch 90 from the one in which it remains disengaged, to the one in which it remains engaged, is described.

As electric power is sent to the solenoid 60, the driving force from the main motor 71 is transmitted to the clutch cam gear 93, and rotates the clutch cam gear 93 in the direction indicated by an arrow mark G. As the clutch cam gear 93 is rotated in the direction indicated by the arrow mark G, the cam-like portion 93*a* of the clutch cam gear 93 and the cam-like portion 95*a* of the clutch disengaging member 95 are disengaged from each other. Thus, the first engaging member 94 is moved toward the second engaging portion 92*a* of the follower gear 92 by the force of the compression spring 97, being thereby made to engage (be placed in contact) with the second engaging portion 92*a* of the follower gear 92. As the clutch cam gear 93 rotates another ⅓ a rotation, the rotation of the clutch cam gear 93 is stopped, and the first engaging member 94 and the second engaging portion 92*a* of the follower gear 92 are kept in the state of being engaged.

By the way, the clutch 90 shown in parts (a) and (b) of FIG. 5 is structured so that each of the cam-like portion 93*a* of the clutch cam gear 93, and the cam-like portion 95*a* of the clutch disengaging portion 95, are provided with a slant surface, and the two surfaces engage with each other when the clutch 90 is changed in the state of operation from the one in which it remains engaged, to the one in which it remains disengaged. However, this embodiment of the present invention is not intended to limit the present invention in scope.

For example, the clutch 90 may be structured so that each of the cam-like portion 93*a* of the clutch cam gear 93, and the cam-like portion 95*a* of the clutch disengaging portion 95, is provided with the second slant surface, and the two second slant surfaces engage with each other when the clutch 90 is changed in the state of operation from the one in which it is remains disengaged, to the one in which it remains engaged. In this case, the cam-like portion 93*a* of the clutch cam gear 93 is provided with the first slant surface, which is slant in such a manner that the more downstream it is in terms of the rotational direction indicated by an arrow mark R, the closer the slant surface is to the clutch driving gear 91, and also, the second slant surface, which is on the downstream side of the first slant surface, and is slant in such a manner that the more downstream it is in terms of the rotation direction indicated by the arrow mark R, the farther it s from the clutch driving gear 91. As for the cam-like portion 95*a* of the clutch disengaging portion 95, it is provided with the first slant surface which is slant in such a manner that the more downstream in terms of the direction indicated by an arrow mark G, which is opposite from the direction indicated by the arrow mark R, the closer it is to the clutch cam gear 93, and the second slant surface which is on the downstream side of the first surface, and is slant in such a manner that the more downstream it is in terms of the direction indicated by the arrow mark G, the farther it is from the first slant surface.

In this case, the operation of the clutch 90, which occurs while the clutch 90 is changed in the state of operation from the one in which it remains disengaged to the one in which it remains engaged, is as follows: As electric power is sent to the solenoid 60, and therefore, the clutch cam gear 93 is rotated, the second surface of the cam-like portion 93*a* of the clutch cam gear 93, and the second surface of the cam-like portion 95*a* of the clutch disengaging portion 95 engage with each other. As the clutch cam gear 93 is further rotated, the first engaging member 94 is moved by the cam-like portion and the force of the compression spring 97, in the direction parallel to the shaft in such a manner that the end portion 94*a* (FIG. 9) of the first engaging member 94 comes closer to the end portion 92*b* (FIG. 9) of the second engaging portion 92*a* of the follower gear 92. As the clutch cam gear 93 rotates ⅓ a rotation, the second slant surface of the cam-like portion 93*a*, and that of the cam-like portion 95*a*, separate from each other, and the first engaging member 94 and the second engaging portion 92*a* of the follower gear 92 become engaged with each other. The cam-like portions may be structured as described above.

By the way, the clutch 90B on the black side, and the clutch 90C on the color side, are different in the shape of their cam-like portions, because of the difference in the state in which they remain engaged, or disengaged. The cam-like portions are to be adjusted in positioning and shape according to the timing with which they are engaged or disengaged, and the change in the state from the one in which they are in engagement, to the one in which they are in disengagement, from the one in which they are in disengagement to the one in which they are in engagement, and from the one in which they are in disengagement to the one in which they remain disengaged, or from the one in which they are in engagement to the one in which they remain engaged.

In the image forming apparatus in this embodiment, each time the solenoid is turned on, the clutch cam gear 93 is rotated by ⅓ a rotation, and the clutch 90B on the black side changed in its state (disengagement→engagement→engagement). Then, as it is rotated a full rotation, it returns to the state of disengagement. On the other hand, as each time the clutch cam gear 93 is rotated ⅓ a rotation by the activation of the solenoid, the clutch 90C on the color side changes in state (disengagement→engagement→disengagement).

When both the cam gears 93B and 93C on the color and black sides, respectively, are remaining disengaged, all the development rollers remain stationary. That is, the image forming apparatus 1 is in the state in which it does not form any image.

When both the cam gears 93B and 93C on the color and black sides, respectively, are remaining engaged, all the development rollers rotate. That is, the image forming apparatus 1 is in the state in which it can form a full-color image.

When the clutch 90C on the color side remains disengaged, and the clutch 90B on the black side remains engaged, the development roller on the black side rotates, and therefore, the image forming apparatus 1 is in the state in which it can form only a black image.

Next, referring to FIG. 8, the problem which might occur when a comparative clutch is changed in state from the one in which it is remaining disengaged, to the one in which it remains engaged, is described. FIG. 8 is an enlarged view of the portion of the comparative clutch, at which the clutch engages or disengage.

Referring to FIG. 8, as the first engaging member 94 begins to engage with the second engaging portion 92*a* of the follower gear 92, the minute arcuate tip of the end portion 94*a* of the first engaging member 94 and the minute arcuate tip of the end portion 92*b* of the second engaging portion 92*a* of the follower gear 92 sometimes come into contact with each other. These minute arcuate portions always result when components are produced. In a case where a gear is molded by the pouring of resin into a mold, the resin sometimes fails to reach the portions of the mold, which correspond to the tips of the engaging portion of the gear. Therefore, the resultant engaging tip portions of an engaging member, engaging tips of a gear, etc., are likely to have a minute arcuate portion. Also in a case where a gear is made by shaving a block of metal, the engaging portion of the resultant gear is likely to have a minute arcuate tip.

As the minute arcuate tip of the end portion 92*b* of the second engaging portion 92*a* of the follower gear 92, and that of the end portion 74*a* of the first engaging member 94, come into contact with each other, the first engaging member 94 is under the force F generated by the compression spring 97 (part (a) of FIG. 5) toward the second engaging portion 92*a* of the follower gear 92, in the direction parallel to the shaft. However, the tips of the portions 92*b* and 94*a* are in contact with each other. Therefore, the first engaging member 94 is not allowed to move in the direction parallel to the shaft.

The force F is changed in direction by the arcuate tips in the area of contact; it becomes a force F,' which is directed from the first engaging member 94 toward the second engaging portion 92*a* of the follower gear 92, in terms of the rotation direction indicated by the arrow mark R.

However, each of the gears of the gear train which is on the downstream side of the follower gear 92 in terms of the rotational direction of the follower gear 92 is in mesh with the adjacent gears, with the presence of no gap between itself and the adjacent gears. Therefore, even when the contact between the engaging portions is very slight, the driving force is transmitted. Further, there is no gap in the gear train which is in the direction of rotation, the force F' cannot rotate the development roller (torque necessary to rotate development is greater than force F').

Therefore, the driving force is transmitted from the first engaging member 94 to the second engaging portion 92*a* of the follower gear 92 while the two portions 94 and 92*a* are remaining incompletely engaged; they are in engagement with each other by only the two minute arcuate portions of theirs.

However, in a case where the clutch 90 is in the state of incomplete engagement as described above, it sometimes occurs that the first engaging member 94 and the second engaging portion 92*a* of the follower gear 92 are disengaged during their rotation, and therefore, the development roller (s) momentarily stops, causing the image forming apparatus 1 to output an unsatisfactory image, for example, an image suffering from unwanted streaks or the like. Further, as the incompletely engaged first engaging member 94 and the second engaging portion 92*a* of the follower gear 92 become completely disengaged from each other, and then, become re-engaged with each other, a large collisional sound suddenly occurs.

In this embodiment, therefore, the driving device 70 is structured so that while the first engaging member 94 and the second engaging portion 92*a* of the follower gear 92 are not in engagement with each other, the follower gear 92 is kept pressed in the opposite direction from the rotational direction of the first engaging member 94. Next, referring to FIGS. 9 and 10, how the second engaging portion 92*a* of the follower gear 92 is kept pressed in its rotational direction is described.

In this embodiment, the driving device 70 is structured so that during an image forming operation, the clutch cam gear 93 is rotated in the opposite direction G from the direction indicated by the arrow mark R, in which the clutch driving gear 91 is rotated by the driving force from the main motor 71.

While the first engaging member 94 and the second engaging portion 92*a* of the follower gear 92 are not in engagement with each other, the clutch cam gear 93 is rotated by the driving force, which it receives from the main motor 71 by way of the upstream gear 99, in the opposite direction indicated by the arrow mark G, from the rotational direction indicated by the arrow mark R. As the charge roller 92 is rotated in the opposite direction, the follower gear 92 is subjected to the force which is generated by the friction (or viscosity of grease (lubricant) in area T of contact), and works in the direction to cause the follower gear 92 to rotate (press) in the direction indicated by the arrow mark G, which is the same direction as the rotational direction of the charge roller 92. However, as the follower gear 92 comes into contact with the surface of one of the tooth of the downstream gear 92 while remaining pressed in the direction indicated by the arrow mark G, it stops while remaining pressed (FIG. 10), because the amount of torque necessary to rotate the development roller is greater than the aforementioned force generated by the friction (viscosity). As it stops, there is a gap which is equal to the meshing gap J, between the follower gear 92 and the downstream gear 93 in terms of the rotational direction R. More specifically, the follower gear 92 is made to rotate in the opposite direction from the direction in which the follower gear 92 rotates as the clutch driving gear 91 rotates in the rotational direction R. Consequently, there occur the mesh gap J, between the tooth of the follower gear 92, which meshes with the downstream gear 98, and the tooth of the adjacent downstream gear 98 in terms of the direction in which the follower gear 92 rotates as the clutch driving gear 91 rotates in the rotational direction R. That is, as the clutch cam gear 93 stops, the follower gear 92 stops while having the meshing gap J between itself and the downstream gear 98 in terms of the rotational direction R. Therefore, it is allowed to freely rotate in the rotational direction by an amount equal to the meshing gap J.

In this embodiment, in which the driving device 70 is structured so that while the first engaging member 94 and the second engaging portion 92*a* of the follower gear 92 are not in engagement with each other, the follower gear 92 is kept pressed in the opposite direction G from the rotational direction of the first engaging member 94, the follower gear 92 has the gap J from the downstream gear 98 in terms of the rotation direction R.

In a case where the first engaging member 94 and second engaging portion 92*a* of the follower gear 92 come into contact with each other by their arcuate tips of their end portions 94*a* and 92*b*, respectively, while the charge roller 92 is holding the gap J (FIG. 9), the follower gear 92 can be rotated in the rotational direction R by the force F1' directed in the rotational direction R. More concretely, with the provision of the meshing gap J between the second engaging portion 92*a* of the follower gear 92 and the downstream gear 98, the follower gear 92 rotates in the rotational direction R, moving thereby in the rotational direction R from the position indicated by a solid line in FIG. 9, to the position indicated by a broken line. Since the driving device 70 is structured so that the follower gear 92 is allowed to move in the direction indicated by the arrow mark R relative to the first engaging member 94, the driving device 70 changes in state from the one in which the first engaging member 94 and the second engaging portion 92*a* of the follower gear 92 are in contact with each other by their minutes arcuate tip portions, to the one in which they are in contact with each other by their surfaces. As a result, it becomes possible for the first engaging member 94 to be moved in the direction parallel to the shaft by the force F generated by the compression spring 97 (part (a) of FIG. 5), and therefore, it becomes possible for the first engaging member 94 and the second engaging portion 92*a* of the follower gear 92 to become completely engaged with each other.

As described above, in this embodiment, while the first engaging member 94 and second engaging portion 92*a* of the follower gear 92 are not in engagement with each other, the second engaging portion 92*a* of the follower gear 92 is kept pressed in the opposite direction G by rotating the clutch cam gear 93 in the opposite direction G from the direction R in which the clutch cam gear 93 is rotated during an image forming operation, to provide gap J between the second engaging portion 92*a* of the follower gear 92 and the downstream gear 98 in terms of the rotational direction in which the clutch cam gear 93 is rotated during an image forming operation. Therefore, it is possible to prevent the problems that because of the incomplete engagement of the clutch, the image forming apparatus 1 outputs an unsatisfactory image and/or generates large collisional sounds during an image forming operation.

Further, in this embodiment, the driving device 70 is structured so that the clutch cam gear 93 is pressed in the opposite direction G from the rotational direction R in which the second engaging portion 92*a* of the follower gear 92 is rotated, by rotating the clutch cam gear 93 in the opposite direction G from the direction R in which the clutch cam gear 93 is rotated during image formation. Therefore, it does not occur that the follower gear 92 rotates in the rotational direction R while the clutch cam gear 93 is in the state of disengagement. Therefore, it does not occur that the first engaging member 94 collides with the second engaging portion 92*a* during the clutch disengagement, and therefore, it does not occur that the image forming apparatus 1 (driving device 74) generates collisional sounds.

That is, this embodiment can prevent the problem that image forming apparatus 1 is subjected to a shock and/or generates collisional sounds during clutch engagement and/or clutch disengagement.

Embodiment 2

Next, referring to FIGS. 11-13, the image forming apparatus in the second embodiment of the present invention. By the way, the image forming apparatus in this embodiment is similar to the one in the first embodiment in general structure. Therefore, it is not described in detail. Further, the members of the image forming apparatus 1 in this embodiment, which are the same as, or similar to, the counterparts in the first embodiment in function are given the same referential codes as those given to the counterparts, and are not described here. In the first embodiment described above, the follower gear of the clutch of the driving device 70, and the second engaging portion 92*a*, are formed as different portions of a single component. In this embodiment, however, the two are independently formed from each other. Hereafter, this structural arrangement is described.

Referring to FIGS. 11 and 12, the follower gear 192 and second engaging member 202 of the driving device in this embodiment are not two portions of a single component, and are held so that they are not allowed to move in the shaft direction, but are rotatable about the shaft. The second engaging member 202 can be in both a state in which it does not engage with the first engaging member 94, and therefore, the driving force from the main motor 71 is not transmitted to the second engaging member 202, and also, a state in which it engages with the first engaging member 94, and therefore, it is rotated about the shaft by the driving force from the main motor 71. There is provided a compression spring 199 between the second engaging member 202 and follower gear 192. One end of the compression spring 199 is held to the spring seating surface rib 192*c* of the follower gear 192, and the other end is held to the spring seating surface rib 202*b* of the second engaging member 202. The follower gear 192 is kept pressed in the direction indicated by the arrow mark R as during an image forming operation, by the force F2 generated by the compression spring 199. The second engaging member 202 is kept pressed in the direction indicated by the arrow mark G, which is opposite from the direction indicated by an arrow mark R'. The force F2 of the compression spring 199 is set to be smaller than the force F' generated by the combination of the minute arcuate tips of the first engaging member 94 and second engaging member 202. By the way, the other components of the clutch of the driving device in this embodiment are similar in structure to the counterparts of the driving device 70 in the first embodiment described above.

During an image forming operation, the rotational force from the first engaging member 94, which is directed as indicated by the arrow mark R, is transmitted to the second engaging member 202, and therefore, the second engaging member 202 is rotated in the direction indicated by the arrow mark R. Thus, a rib 202*a*, which is the first point of contact of the second engaging member 202, comes into contact with a rib 192*a*, which is the second point of contact of the follower gear 192, whereby the rotational force is transmitted. Thus, the follower gear 192 is rotated with the second engaging member 202 about the shaft, in the direction indicated by the arrow mark R.

When the rotational force is not transmitted to the second engaging member 202, the follower gear 192 remains pressed in the direction indicated by the arrow mark R, which is the same as the direction in which it is rotated during an image forming operation by the force F2 of the compression spring 199, whereas the second engaging member 202 remains pressed in the direction indicated by the arrow mark G, which is opposite from the direction (indicated by arrow mark R) of rotation of the second engaging member 202, by the force F2 of the compression spring 199. Here, even after the disengagement of the engaging members from each other, the follower gear 192 is kept by the force F2 of the compression spring 199, in the state in which the surface of one of its teeth in the rotation direction R, and the surface of one of the teeth of the downstream gear 198 are in contact with each other. On the other hand, as the engaging members are made to disengage from each other, the second engaging member 202 is rotated by the force F2 of the compression spring 199 to a position in which the spring seating surface rib 202*b* of the second engaging member 202 comes into contact with the rib 192*b* of the follower 192, whereby the rotation of the second engaging member 202 in the direction indicated by the arrow mark G is stopped.

At this point in time, the follower gear 192 and second engaging member 202 has the gap K in the direction indicated by the arrow mark R. More concretely, they have the gap K between the rib 202*a* of the second engaging member 202 and the rib 192*a* of the follower gear 192, which come into contact with each other while transmitting the rotational force transmitted from the first engaging member 94.

In the state in which there is this gap K, the force F' attributable to the minute arcuate tips is greater than the force F2 generated by the compression spring 199. Therefore, even if the minute arcuate tip 94*a* of the first engaging member 94, and the minute arcuate tip 202*c* of the second engaging member 202 come into contact with each other as shown in FIG. 3, the follower gear 192 can be rotated in the direction indicated by the arrow mark R. As the follower gear 192 is rotated in the direction indicated by the arrow mark R relative to the first engaging member 94, the driving device changes in state from the one in which the minute arcuate tips of the first engaging member 94 and second engaging member 202 are in contact with each other, to the one in which the surface of the first engaging member 94 and the surface of the second engaging member 202 are in contact with each other. Consequently, it becomes possible for the first engaging member 94 to be moved by the force F of the compression spring 97 (part (a) of FIG. 5) in the shaft direction, and therefore, the first engaging member 94 and second engaging member 202 are allowed to completely engage with each other.

As described above, in this embodiment, while the first engaging member 94 and second engaging member 202 are not in engagement with each other, the gap K is provided between the first engaging member 94 and follower gear 192, in terms of the direction indicated by the arrow mark R, in which the second engaging member 202 is rotated during an image forming operation, by keeping the second engaging member 202 pressed in the opposite direction indicated by the arrow mark G from the direction indicated by the arrow mark R during an image forming operation. With the provision of this gap J, it is possible to prevent the problem that because of the unsatisfactory engagement of the clutch, the image forming apparatus 1 forms an satisfactory image, and/or generates collisional sounds.

Further, in this embodiment, the driving device is structured so that the second engaging member 202 is kept pressed in the opposite direction, indicated by the arrow mark G, from the rotation direction of the first engaging member 94. Therefore, it does not occur that when the clutch is engaged or disengaged, the first engaging member 94 collides with the second engaging member 202, and therefore, collisional sounds are generated.

That is, this embodiment also can prevent the problem that when the clutch is engaged or disengaged, the image forming apparatus 1 (driving device 70) is subjected to a shock, and collisional sounds are generated.

MISCELLANIES

In the embodiments described above, the driving device was structured so that the first engaging member of its clutch as a clutching means, is movable in the shaft direction. These embodiments, however, are not intended to limit the present invention in scope. For example, the driving device may be structured so that the second engaging member of its clutch is movable in the shaft direction. In such a case, the driving device is structured so that the second engaging member is kept pressed in the direction to engage with the first engaging member. Further, it is structured so that as its disengaging member is moved in the shaft direction by the rotation of its cam gear, the disengaging member makes the second engaging member separate from the first engaging member, by moving the second engaging member in the shaft direction. Even if the driving device is structured as described above, effects similar to those obtainable by the driving devices in the preceding embodiments can be obtained.

Further, in the first embodiment described above, the driving device was structured so that the follower gear and the second engaging member are formed as parts of a single component, and the second engaging member is kept pressured in the opposite direction from the direction of rotation of the first engaging member to provide a gap between the two engaging members in terms of the direction in which they are rotated during an image forming operation. This embodiment, however, is not intended to limit the present invention in scope. For example, the present invention is also applicable to a driving device structured so that the follower gear of the clutch, and second engaging member are formed parts of a single component, and the follower gear of the clutch is kept pressed in the opposite direction from the direction in which the first engaging member is rotated, to provide a gap between the follower gear and first engaging member in terms of the rotation direction. The application of the present invention to such a driving device can provide the same effects as those obtainable by the first embodiment.

Further, in the embodiments described above, the process cartridge which is removably installable in the image forming apparatus 1 was such a process cartridge that comprises the photosensitive drum, and processing means, more specifically, a charging means, a developing means, and a cleaning means, which process the photosensitive drum. These embodiments, however, are not intended to limit the present invention in scope. For example, the present invention is also compatible with a process cartridge which comprises any of the charging means, developing means, and cleaning means, in addition to a photosensitive drum.

Also in the embodiments described above, the image forming apparatus 1 was structured so that the process cartridge which comprises the photosensitive drum is removably installable in the main assembly of the image forming apparatus 1. These embodiments, however, are not intended to limit the present invention in scope. For example, the present invention is also compatible with such an image forming apparatus that its photosensitive drum, and each of the processing means for processing the photosensitive drum, are integral parts of the apparatus, or that its photosensitive drum, and each of the processing means for processing the photosensitive drum, are individually and removably installable in the main assembly of the image forming apparatus.

Moreover, in the embodiments described above, the image forming apparatus 1 was a printer. These embodiments, however, are not intended to limit the present invention in scope. That is, the present invention is also applicable to other image forming apparatuses than those in the preceding embodiments. For example, the present invention is also applicable to a copying machine, a facsimileing machine, or the like, and also, a multifunction image forming machine which is capable of functioning as any of the abovementioned ones. Further, the application of the present is not limited to an image forming apparatus which sequentially transfers in layers, multiple toner images, different in color, onto its intermediary transferring member with the use of its intermediary transferring member, and then transfers the toner images on the intermediary transferring member all at once onto a sheet of recording medium. For example, the present invention is also applicable to an image forming apparatus which uses a sheet bearing member, and sequentially transfers in layers, the multiple toner images, different in color, onto a sheet of recording medium borne on the sheet bearing member. Application of the present invention to these image forming apparatuses can also provide the effects similar to those obtainable by the image forming apparatus in the first and second embodiments of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-145040 filed on Aug. 7, 2019, which is hereby incorporated by reference herein in its entirety.

What is claimed is:

1. A driving device for rotating a plurality of photosensitive members and a plurality of developing rollers, said driving device comprising:

a clutch configured to selectively transmit a rotational force outputted from a driving source, to the developing rollers;

said clutch including, a driving member provided with a first engaging portion and rotatable toward a rotational direction about an axis thereof by receiving the rotational force outputted from said driving source together with said first engaging portion, a follower member configured to rotate the developing roller by receiving the rotational force transmitted from the driving member, the follower member provided with a second engaging portion contactable with said first engaging portion, said follower member being rotatable about the axis together with said second engaging portion by contacting of said first contact portion with said second contact portion, a rotatable member capable of changing, by rotation in an opposite rotational direction opposite from the rotational direction of said driving member, a state from (i) a first state in which the first engaging portion separates from the second engaging portion and the rotational force from said driving source is not transmitted to the developing roller, to (ii) a second state in which said developing roller is rotated by engagement between said first engaging portion and said second engaging portion, wherein said rotatable member contacts said follower member, and said rotatable member urges said follower member in the opposite rotational direction when said first engageable member and said second engageable member are not engaged with each other, by rotation in the opposite rotational direction.

2. A driving device according to claim 1, wherein said driving member includes an urging member configured to urge said first engaging portion which is movable in the axial direction for engagement with said second engaging portion, and the rotatable member includes a first cam, wherein said clutch includes, a releasing member including a second cam being contactable with the first cam, said releasing member being supported so as to be movable in the axial direction and being engaged with said first engaging portion, and a controller configured to control to rotate said rotatable member, wherein by rotating said rotatable member in the opposite direction to engage said second cam and said first cam with each other, said releasing member is moved in the axial direction against an urging force of said urging member to move said first engaging portion in the axial direction, thus releasing engagement with said second engaging portion, wherein said first engaging portion is moved in the axial direction by said urging member to engage with said second engaging portion, by rotating said rotatable member in the rotational direction same as that of said driving member to release the engagement between said second cam and said first cam.

3. A driving device according to claim 1, wherein said rotatable member is rotatably fitted with said follower member.

4. A driving device according to claim 1, wherein said follower member includes a gear portion in meshing engagement with a downstream gear, and a gear tooth of said gear portion is spaced, when said driving member is rotated in the rotating direction thereof, from an adjacent gear tooth of the downstream gear in a direction of rotation of said gear portion, by the rotation in the opposite direction.

5. A driving device according to claim 1, wherein said rotatable member urges said follower member in the opposite direction by a frictional force at a contact portion relative to said follower member.

6. A driving device according to claim 1, wherein said rotatable member urges said follower member in the opposite direction by the way of a lubricant provided at a contact portion relative to said follower member.

7. An image forming apparatus, comprising:

a plurality of photosensitive members;

a plurality of developing rollers configured to develop an electrostatic latent image formed on said photosensitive member; and a driving device according to claim 1.

8. A driving device according to claim 1, wherein the driving member, the follower member and the rotatable member are gears.

9. A driving device for rotating a plurality of photosensitive members and a plurality of developing rollers, said driving device comprising: a clutch for selectively transmitting a rotational force outputted from a driving source, to a developing roller;

the clutch including, a driving member provided with an engaging portion and rotatable about an axis thereof by receiving the rotational force outputted from said driving source together with said engaging portion, an engageable member engageable with said engaging portion having a first contact portion and a receiving portion, a follower member configured to rotate the developing roller by receiving the rotational force transmitted from the driving member, the follower member including a second contact portion contactable with said first contact portion, said follower member being rotatable about the axis together with said engaging portion by contacting of said first contact portion with said second contact portion, an urging portion provided between the receiving portion of said engageable member and said follower member so as to contact the receiving portion and said follower member, the urging member configured to urge said engageable member in a direction opposite from a rotational direction of said driving member so as to separate said second contact portion from said first contact portion, when the engagement between said engageable member and said engaging portion is released, and wherein a position of the first contact portion is different from a position of the receiving portion with respect to the rotational direction.

10. An image forming apparatus comprising:

a plurality of photosensitive members;

a plurality of developing rollers configured to develop an electrostatic latent image formed on said photosensitive member; and a driving device according to claim 9.

11. A driving device according to claim 9, the first contact portion includes a plurality of first portions, the second contact portion includes a plurality of second portions, each of the plurality of first portions is configured to contact each of the plurality of second portions.

12. A driving device configured to rotate a roller by transmitting a force transmitted from a driving source to the roller, the driving device comprising:

a driving portion including a first engaging portion, the driving portion configured to receive the force transmitted from the driving source such that first engaging portion rotates toward a first direction about an axis;

a driven gear configured to rotate the roller, the driven gear being rotatable about the axis, the driven gear including a second engaging portion, the driven gear being rotated toward the first direction when the second engaging portion engages the first engaging portion and is rotated toward the first direction, a rotatable member configured to rotate so as to change a state of engagement of the first engaging portion and the second engaging portion from (i) a first state in which the first engaging portion separates from the second engaging portion, to (ii) a second state in which the first engaging portion contacts the second engaging portion such that the second engaging portion is rotated by the first engaging portion, wherein the rotatable member contacts the driven gear, and the rotatable member is configured to rotate toward a second direction opposite from the first direction about the axis when the first engaging portion separates from the second engaging portion so as to urge the second engaging portion toward the second direction.

13. A driving device according to claim 12, wherein the rotatable member is a third gear configured to rotate about the driven gear.

14. A driving device according to claim 12, wherein the rotatable member is provided with a hole into which the driven gear is inserted.

15. A driving device according to claim 12, wherein the first engaging portion is movable relative to the second engaging portion in a direction of the axis, the driving device further comprising:

a releasing member configured to be moved by the rotatable member so as to move the first engaging portion relative to the second engaging portion in the direction of the axis.

16. A driving device according to claim 15, wherein the rotatable member includes a first cam and the releasing member includes a second cam contactable with the first cam, the releasing member is moved in the direction of the axis by contacting of the first cam with the second cam.

17. A driving device according to claim 12, wherein the first engaging portion faces the second engaging portion in a direction of the axis.

18. A driving device according to claim 12, wherein the driving portion includes a driving gear configured to receive the force transmitted from the driving source to rotate the first engaging portion toward the first direction.

* * * * *